US006883935B2

(12) United States Patent
Lassovsky

(10) Patent No.: US 6,883,935 B2
(45) **Date of Patent: *Apr. 26, 2005**

(54) QUICK CONNECT REFLECTOR HOLDER

(76) Inventor: Leon Lassovsky, Castillo de Utern #1, Seville 41013 (ES)

( * ) Notice: Subject to any disclaimer, the term of this patent is extended or adjusted under 35 U.S.C. 154(b) by 41 days.

This patent is subject to a terminal disclaimer.

(21) Appl. No.: 10/254,367

(22) Filed: Sep. 25, 2002

(65) Prior Publication Data

US 2003/0026098 A1 Feb. 6, 2003

Related U.S. Application Data

(63) Continuation of application No. 09/817,914, filed on Mar. 26, 2001, now Pat. No. 6,607,289.

(51) Int. Cl.[7] ..... F21V 14/04

(52) U.S. Cl. ..... 362/283; 362/297; 362/346

(58) Field of Search ..... 362/257, 260, 362/277, 282, 283, 284, 296, 297, 341, 342, 346, 396, 449; 248/300, 74.3, 22.11, 73, 74.1; 24/292, 297, 581.11, 453, 289, 291; 403/294, 329; 411/508–510

(56) References Cited

U.S. PATENT DOCUMENTS

| | | | | | |
|---|---|---|---|---|---|
| 1,421,838 | A | | 7/1922 | Schaeffer | |
| 3,099,403 | A | | 7/1963 | Strawick | 240/47 |
| 3,166,253 | A | | 1/1965 | Aron | 240/46.09 |
| 3,764,729 | A | * | 10/1973 | Kowalewski | 411/508 |
| 3,866,036 | A | | 2/1975 | Taltavull | 240/51.11 |
| 3,909,883 | A | * | 10/1975 | Fegen | 411/508 |
| D257,950 | S | * | 1/1981 | Van Meter, Jr. et al. | D8/396 |
| 4,499,529 | A | | 2/1985 | Figueroa | 362/283 |
| 4,625,267 | A | | 11/1986 | Mikalonis | 362/150 |
| 4,651,259 | A | | 3/1987 | Wendel | 362/217 |
| 5,046,223 | A | * | 9/1991 | Kraus | 24/453 |
| 5,426,575 | A | | 6/1995 | Richards | 362/283 |
| 5,724,709 | A | * | 3/1998 | Kittmann et al. | 24/453 |
| 5,816,691 | A | | 10/1998 | Gordin et al. | 362/283 |
| 5,855,427 | A | * | 1/1999 | Lassovsky | 362/283 |
| 6,076,943 | A | * | 6/2000 | Lassovsky | 362/283 |
| 6,206,548 | B1 | * | 3/2001 | Lassovsky | 362/283 |
| 6,607,289 | B2 | * | 8/2003 | Lassovsky | 362/283 |

* cited by examiner

*Primary Examiner*—John Anthony Ward
*Assistant Examiner*—Ismael Negron
(74) *Attorney, Agent, or Firm*—Gifford, Krass, Groh, Sprinkle, Anderson & Citkowski, PC

(57) ABSTRACT

A reflector holder retains a reflector that has a hole in one of its ends. The holder includes a base with a quick-connect connector extending from the base. In one version, the quick-connect connector includes a semi-arcuate flange member that extends from the base. The member has a pair of edges extending between the base and the outward end of the flange member and a mid-portion between the edges. The member also has a concave side and a convex side. A connection post extends from the mid-portion of the concave side of the end of the member away from the base, and terminates in an outward end. A pair of lock ears extend from the outward end of the connection post, with one ear extending toward each of the edges of the flange member. Each lock ear terminates in a locking end that is spaced from one of the edges so as to define a gap between the locking end and edge. Another version of a quick-connect connector includes an upper jaw and a lower jaw that extend from the base and have a gap defined between the jaws. The upper jaw has a tooth that extends across the gap. The reflector is retained in the gap with the tooth extending through the hole in the reflector.

9 Claims, 24 Drawing Sheets

QUICK CONNECT REFLECTOR HOLDER

REFERENCE TO RELATED APPLICATIONS

This is a continuation of Ser. No. 09/817,914 filed Mar. 26, 2001, U.S. Pat. No. 6,607,289 the entire contents of which are incorporated herein by reference.

FIELD OF THE INVENTION

This invention generally relates to a luminaire, and more particularly, to a luminaire having quick connect devices for holding reflectors, especially in a luminaire wherein the reflectors are adjustably positionable to increase efficiency and energy conservation.

BACKGROUND OF THE INVENTION

Luminaires or light fixtures for use with fluorescent bulbs have been in use for many years. Luminaires typically have rectangular box-like bodies which are adapted to be mounted in ceilings. The luminaire is generally provided with some type of reflectors positioned longitudinally behind or alongside of the fluorescent bulb to reflect light outwardly from the luminaire into the area desired to be lit.

Recently, energy conservation and efficiency of luminaires has been improved by the use of reflectors formed of specular material, such as silver or aluminum. These materials reflect light with greater precision than previous materials and permit the lighting engineer to control the manner in which the light is reflected.

State of the art luminaires are currently custom manufactured to meet luminosity criteria desired for the installation site. To ensure the installation of the most suitable lighting fixtures, on-site measurements are taken, appropriate reflector designs are chosen, and the reflector material, usually in the form of sheet metal, is bent or molded into reflectors composed of many precise angles at which the light is to be reflected without causing unsightly overlap with the resultant beams of light. Such a procedure is time consuming and expensive. If the measurements are not carefully taken, it may be necessary to rebuild the luminaire or to make other adjustments which lead to diminution of the efficiency of the energy utilized.

It is also known to provide a luminaire with movable reflectors which may be positioned to change the physical dimensions of the light column produced by the light fixture, such as disclosed in U.S. Pat. No. 3,099,403 to Strawick.

It is also known as disclosed in U.S. Pat. No. 3,166,253 to provide a luminaire having a plurality of movable slats or reflectors positioned outwardly from fluorescent bulbs. The reflectors are movable together like a Venetian blind to simulate natural light coming through a Venetian blind. However, none of these devices provide the necessary adjustments to increase energy efficiency and energy conservation.

Applicant's U.S. Pat. Nos. 5,855,427 and 6,076,943 and Applicant's co-pending application Ser. No. 09/383,311 disclose various types of luminaires having adjustable reflectors mounted above and to the sides of the bulb. This allows adjustment of the reflected light pattern projected by the luminaire. Obviously, these adjustable reflectors must be supported in some manner. Generally, the reflectors are supported therein by interconnecting the ends of the reflector with some type of rotational support. Interconnection between the support and the end of each reflector may be made using a connector such as a screw or bolt. However, these types of connectors are labor intensive. Therefore, there remains a need for a quick connect type connector for this application.

SUMMARY OF THE INVENTION

Thus disclosed is a novel luminaire having an outer body and a support structure for mounting of both fixed and pivotable reflectors. The support structure is positionable within the body to widen or narrow the width of the beam of light emitted from the luminaire. Additionally, the support structure can be angled within the body to provide an asymmetrical light beam if desired. The movable reflectors are mounted to pivotal mounts connected to positioning rods to provide precise adjustment of the directional light reflectivity. The reflectors are mounted to brackets to permit ready substitution of reflectors having different reflection characteristics. Alternatively, the luminaire can be provided with a two-sided or three-sided reflector, each of the sides having different reflective characteristics. The reflectors are pivotable so that the side with the desired characteristics can be chosen.

Also disclosed is a novel reflector assembly for reflecting light from a bulb in a luminaire. The luminaire is of the type having an elongated body with a top and a pair of sidewalls defining an opening for permitting a beam of light to be emitted. The luminaire also has first and second ends and supports a bulb in the elongated body between the light emitting opening and the top. The reflector assembly includes a reflector support unit which can be mounted within the body of the luminaire between the opening and the top. The ends of the support unit are configured to interconnect with the ends of the luminaire body and are independently, vertically adjustable in a linear direction so as to adjust the distance between each end of the support unit and the corresponding end of the opening in the luminaire body. The reflector assembly includes one or more reflectors mounted to the support unit that reflect light from the bulb. In some embodiments, a plurality of reflectors is included, each positioned to reflect a portion of the light coming from the luminaire bulb. In some embodiments, the reflectors are pivotally mounted to the support unit so that they can pivot around their longitudinal axis.

Additionally, there is disclosed a modular luminaire and the modules for constructing such a module luminaire. The modules include a housing with a cavity therein. The housing is either configured to mount within a luminaire frame or to connect to the end of a luminaire shell and to cooperate with the second module so as to form a complete luminaire. The module has at least one bulb holder that is supported by the housing and a plurality of rotatably adjustable reflector holders supported by the housing. The rotatably adjustable reflector holders are designed to engage the ends of elongated reflectors. The module also has at least one geared reflector adjuster to adjust the rotational position of at least one of the reflector holders. The reflector adjuster is at least partially disposed in the cavity of the housing.

There are also disclosed two embodiments of a quick-connect reflector holder for quickly and easily retaining a reflector and a luminaire. The quick-connect reflector holder includes a base and a quick-connect connector extending from the base. The connector is configured to engage a connection feature, such as a hole, in the end of the reflector such that the reflector can be interconnected with the base of the holder by engaging the connector with the connection feature. In one embodiment, the quick-connect connector includes a semi-arcuate flange member extending into the base. The flange member has a concave side with a connection post extending from the concave side to an outward end. The connector also includes a lock ear which extends from the outward end of the connection post toward the flange. The lock ear retains the reflector against the flange. In another embodiment, the quick-connect connector includes an upper jaw and a lower jaw with a gap between them. The upper jaw has a tooth that extends across the gap. The reflector is retained in the gap with the tooth extending through the hole in the reflector.

A more complete understanding of this invention may be obtained from the following detailed description as well as taken with the accompanying drawings.

DETAILED DESCRIPTION OF THE PREFERRED EMBODIMENTS

Figure 1:
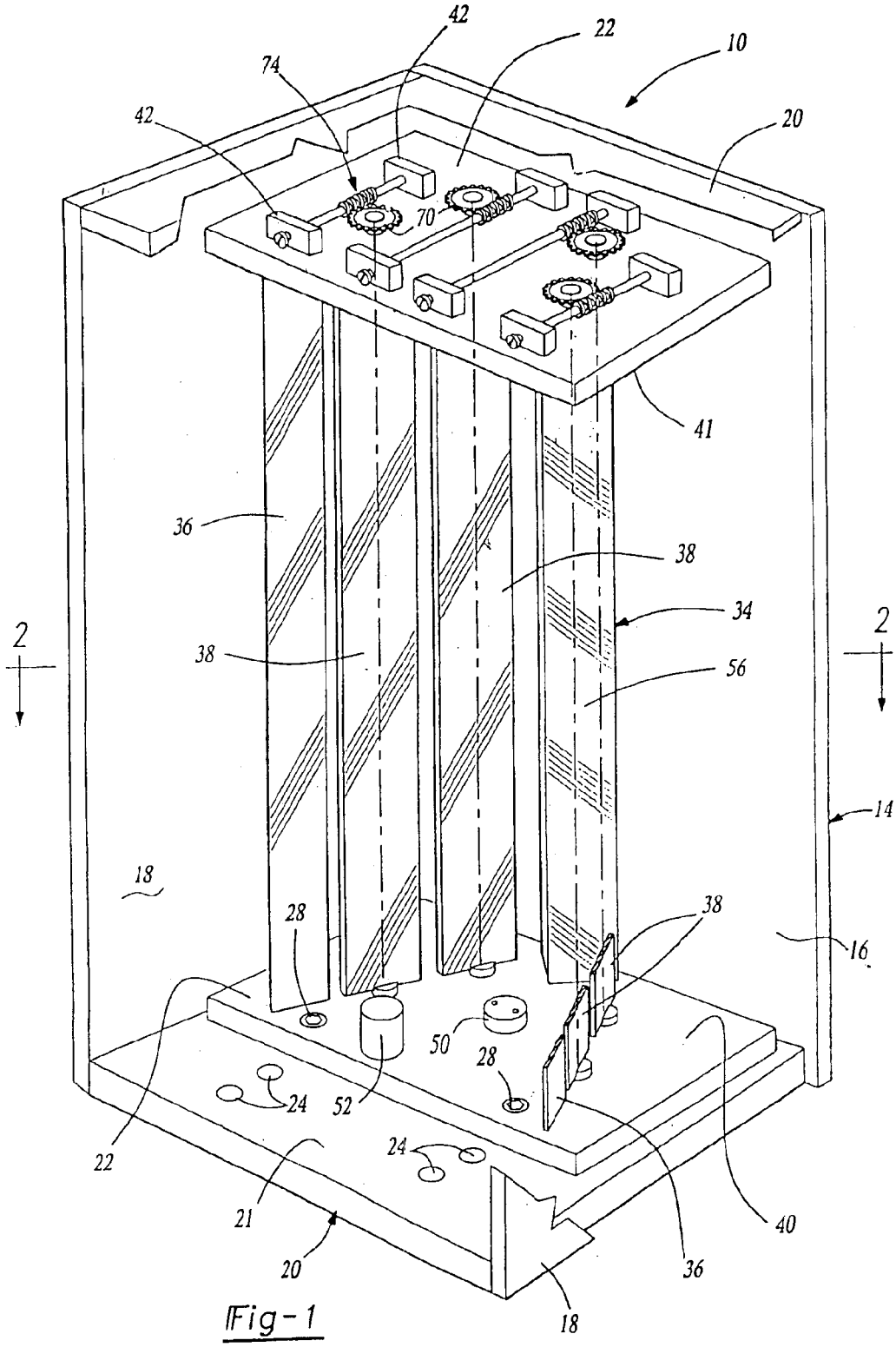
FIG. 1 is a partially exploded perspective view of a luminaire according to the invention.
Figure 2:
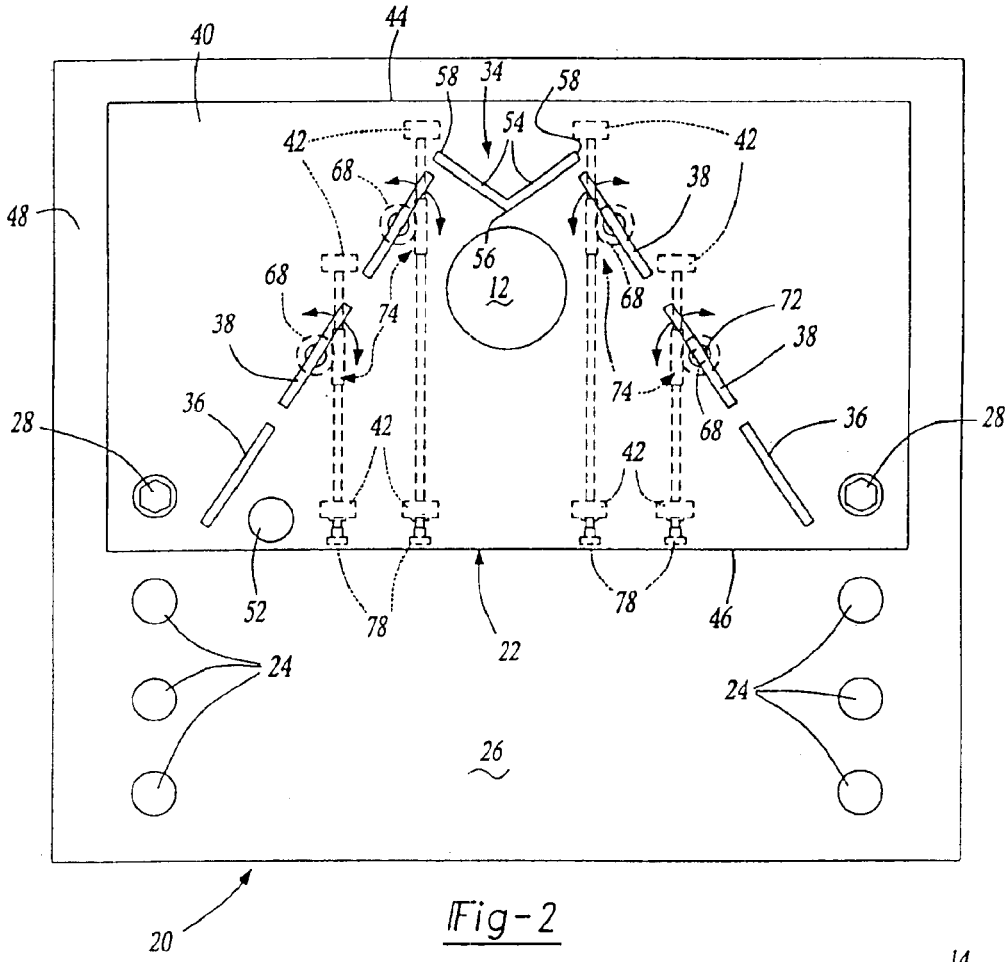
FIG. 2 is a cross-sectional view of the luminaire taken along lines 2—2 of FIG. 1.

A luminaire 10 for a fluorescent light 12 according to the invention is best shown in FIGS. 1 and 2. The luminaire 10 is suitable for mounting in a ceiling suspended or recessed in a ceiling or wall (not shown). The luminaire 10 includes a rectangular box-like body 14 having an opening for accepting a conventional lite (not shown). The body 14 has a top 16 and a pair of sides 18 which extend between a pair of ends 20. The body 14 is formed of a rigid, heat resistant material such as aluminum.

A support unit 22 is adjustably mounted to inner sides 26 of each end 20 of the body 14. Two vertically aligned rows of threaded apertures 24 are formed in the ends 20 for receiving bolts 28 for mounting the support unit 22 to the body 14.

Figure 3A:
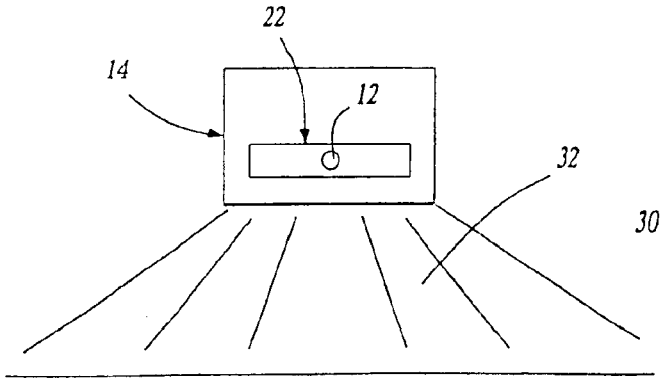
FIG. 3*a* is a schematic end view of the luminaire with the support unit in a lowered position producing a wide distribution beam of light.
Figure 3B:
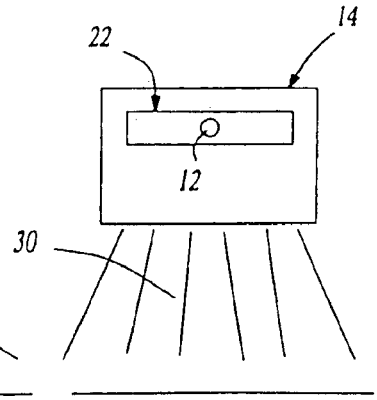
FIG. 3*b* is a schematic view of the luminaire with the support unit in a raised position producing a narrow distribution beam of light.

As discussed more, fully below, and shown in FIGS. 3*a* and 3*b*, the rows of apertures 24 permit mounting of the support unit 22 in a range of positions to vary the width of the projected beam of light. In a raised position shown in FIG. 3*b*, the support unit 22 projects a narrow width beam 30 of light. In a lower position, shown in FIG. 3*a*, the support unit 22 projects a wide width beam 32 of light. The support unit 22 may be angled with respect to the opening 21 for producing an asymmetric beam of light.

As shown in FIG. 2, the support unit 22 includes a pair of end pieces 40, 41 supporting the fluorescent bulb 12, a fixed center reflector 34, a pair of fixed side reflectors 36 and two pairs of movable reflectors 38. The end pieces 40, 41 are generally rectangular in shape having an inner edge 44, outer edge 46, and a pair of side edges 48. As discussed more fully below, the end piece 40 is spaced apart from the inner surface 26 of the housing 14 by spacer brackets 42. The ends of the fluorescent bulb 12 are received in sockets 50 mounted on each end piece 40, 41. The bulb 12 thus extends along a longitudinal axis within the body 14 and support member 22. An electronic ballast 52 is also mounted on the end piece 40.

The fixed center reflector 34 is mounted by brackets to each end piece 40, 41. The center reflector 34 has two lateral sides 54 extending in a AV@ from a corner 56. The corner 56 of the AV@ is mounted between the socket 50 and the inner edge 44 of the end pieces. The sides 54 of the center reflector 34 extend parallel with the longitudinal axis of the fluorescent bulb 12 to reflect light through the opening 21.

Figure 13:
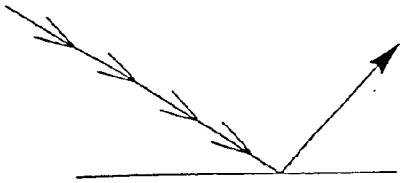
FIG. 13 is a diagram showing a light ray being reflected from a specular surface.
Figure 14:
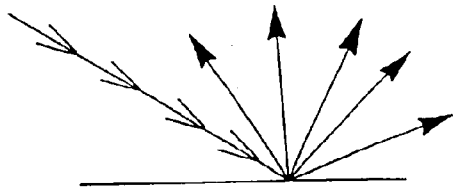
FIG. 14 is a diagram of a light beam being reflected from a diffuse surface.

The fixed side reflectors 36 are mounted on either side of the bulb 12 adjacent the outer edge 48 of the end pieces 40, 41. In the preferred embodiment, the fixed reflectors 36 extend along a plane which extends parallel to the longitudinal axis of the fluorescent bulb 12 and intersects the outer edge 58 of each side 54 of the center reflector. The fixed reflectors 36 are made of suitable rigid material and are coated to reflect light. The reflectors 34, 36 may be provided with any of a variety of coatings or materials to provide either spectral reflection or diffuse reflection. For instance, silver coating will provide a reflection with a minimal diffuse reflection, while a white enamel coating will provide a relatively low spectral reflection with a relatively great diffuse reflection. These types of reflection are illustrated in FIGS. 13 and 14. FIG. 13 shows how light is reflected from a specular surface such as one with a silver coating. FIG. 14 shows how light is reflected from a diffuse surface such as one having a white enamel coating.

As best shown in FIGS. 1,2, 4 and 4*a*, the movable reflectors 38 are mounted to the end pieces by an adjustment mechanism including mounting brackets 42 and an adjustment rod 74. The mount 62 has a shaft 66 extending from a flange 68 for mounting the removable reflector 38. The shaft 66 is positioned through an aperture 72 in the end piece with the flange 68 extending outwardly from the inner surface of the end piece. A gear wheel 70 is mounted on an opposite end of the shaft 66 extending into the space formed by the spacer bracket 42 between the end piece 41 and the body 14.

Figure 4:
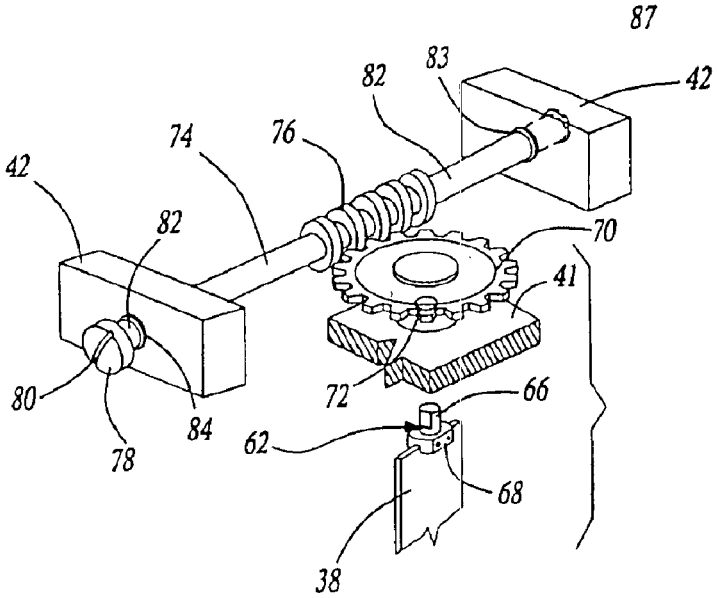
FIG. 4 is a perspective view of an adjustment mechanism for the movable reflectors in accordance with the invention.

As best shown in FIG. 4, an adjustment rod 74 having a worm gear 76 is mounted in meshing engagement with each gear wheel 70 by the pair of spacer brackets 42. Each adjustment rod 74 has an outer end having a head portion 78 having a slot 80 for accepting a blade of a screwdriver for rotating the rod 74. The outer surface may be grooved or knurled to facilitate rotation by hand. The worm gear 76 is positioned between a pair of cylindrical portions 82 which are received in an aperture 83 of each of the respective spacer brackets 42. An annular flange or stop 84 is formed on the rod to abut each bracket 42 to position the head portion 78 of the rod near the outer edge 46 of the end piece and position the worm gear 76 in engagement with the gear 70.

Figure 5:
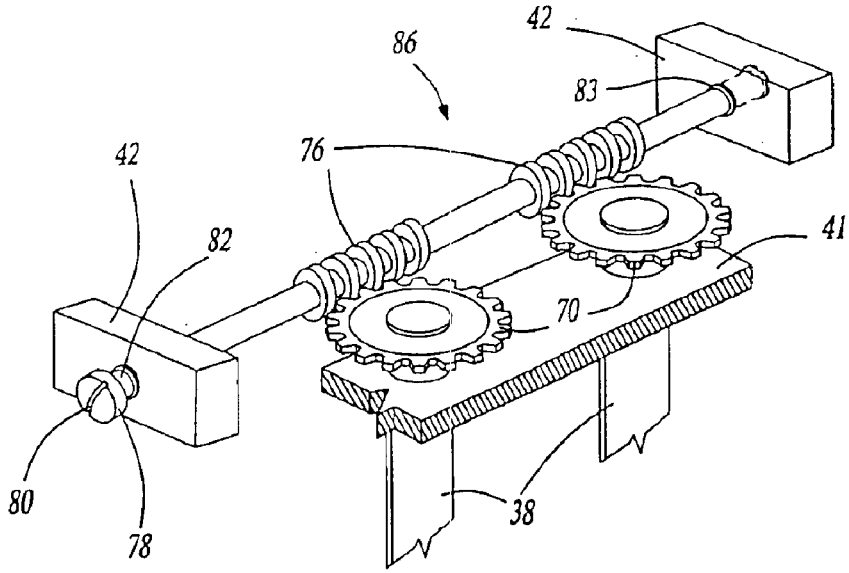
FIG. 5 is a first alternative embodiment of an adjustment mechanism for the movable reflector.

A first alternative embodiment of the adjustment mechanism is shown in FIG. 5. A rod 86 is formed with a pair of worm gears 76 to engage a pair of gear wheels 70 to adjustment of a pair of reflectors simultaneously.

Figure 6:
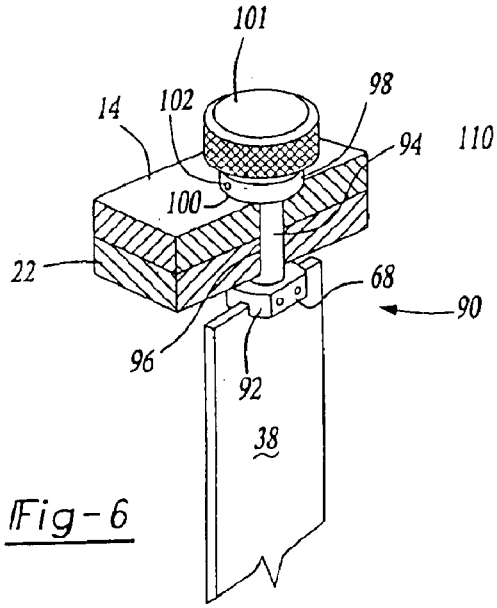
FIG. 6 is a perspective view of a second alternative adjustment assembly for the reflectors.

A second preferred embodiment of the adjustment mechanism is shown in FIG. 6, in which the end pieces of the support unit are mounted directly to the body without brackets 42. The reflectors 38 are pivotally mounted by a mount 90 which has a flange 68 extending from a disk 92 mounted to a shaft 94 which is formed to extend through the bore 96 which is formed through both the support unit 22 and the body 14. The end of the shaft 94 may be provided with a slot 80 as above or knurled to accept a knob 101. A disk 98 having a collar 100 and set screw 102 is mounted to secure the shaft 94 in position in the bore 96.

Figure 4A:
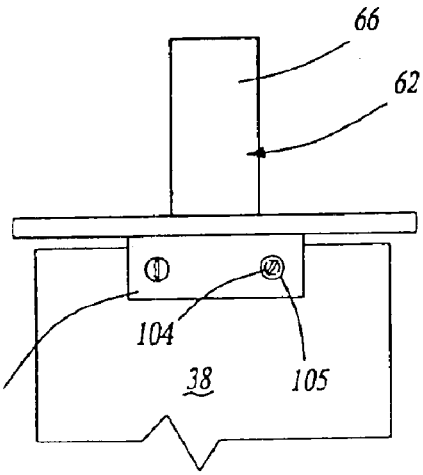
FIG. 4*a* is a partial side view of a mounting mechanism and a reflector.
Figure 7:
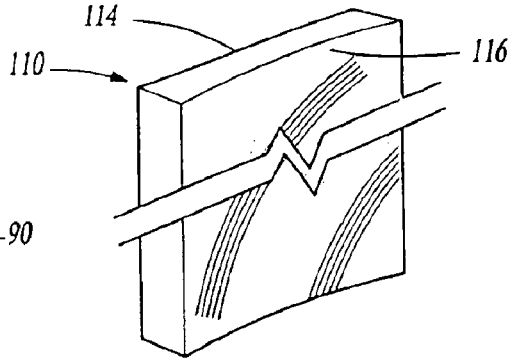
FIG. 7 is a perspective view of a two-sided reflector in accordance with the invention.
Figure 8:
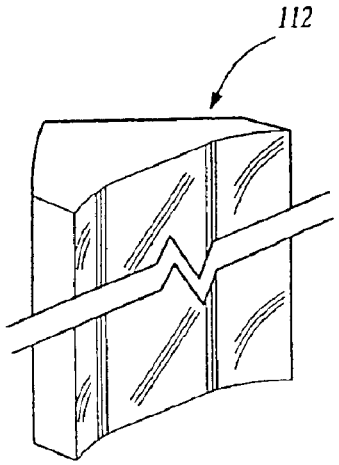
FIG. 8 is a perspective view of a three-sided reflector in accordance with the invention.

As shown in FIG. 4*a*, each rotating reflector 38 is rectangular and formed of a rigid material, such as aluminum or fiberglass. It is advantageous to proportion the width of the reflector to range between the diameter and circumference of the lamp, for instance, between 2" and 4.5". The length of the reflector 38 is approximately equal to the length of the fluorescent bulb 12. This length can exceed 70 inches in length. At least one hole 104 is formed at each end of the reflector 38 for receiving a screw 105 for attachment to the flange 68 of the mount. The reflector is shown in FIG. 4 with a flat surface. However, other surface shapes, such as concave or convex, can be used to provide the desired optics. As shown in FIGS. 7 and 8, a two surface reflector 110 or a three surface reflector 112 may be used. The two surface reflector 110 has a flat surface 114 and a concave surface 116. However, any other shape can be provided. The surfaces may have the same shape with different coatings. The two surface reflector 110 allows the user the option of rotating the reflector 110 from flat surface 114 to a concave surface 116 according to the illumination criteria used.

Figure 9A:
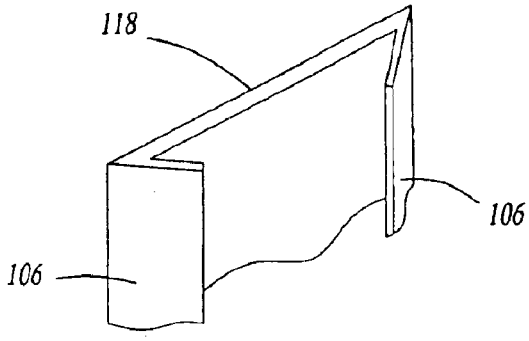
FIG. 9*a* is a perspective view of a reflector having a flat reflective surface.
Figure 9B:
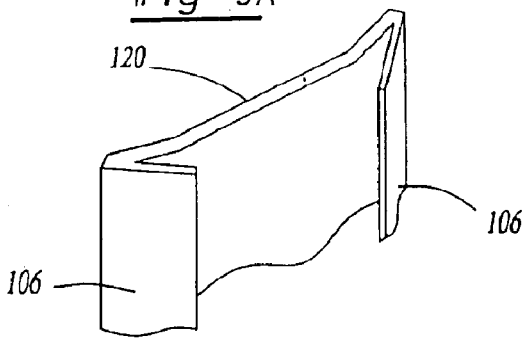
FIG. 9*b* is a perspective view of a reflector having a concave reflective surface.
Figure 9C:
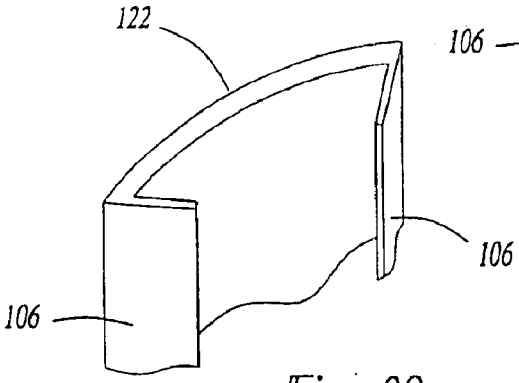
FIG. 9*c* is a perspective view of a reflector having a convex reflective surface.

As shown in FIGS. 8, 9*a*, 9*b*, and 9*c*, the three surface reflector 112 can be produced by combining a flat surface reflector 118 as shown in FIG. 9*a*, a concave surface reflector 120 as shown in FIG. 9*b*, together with a convex surface reflector 122 as shown in FIG. 9*c*. The reflectors are joined by fastening angled flanges 106 together.

Although shown with two pairs of reflectors 38, three pairs or more may be provided. The spacing between the reflectors 38 permits an effective flow of cooling air to flow through the luminaire to cool the fixture.

Figure 10:
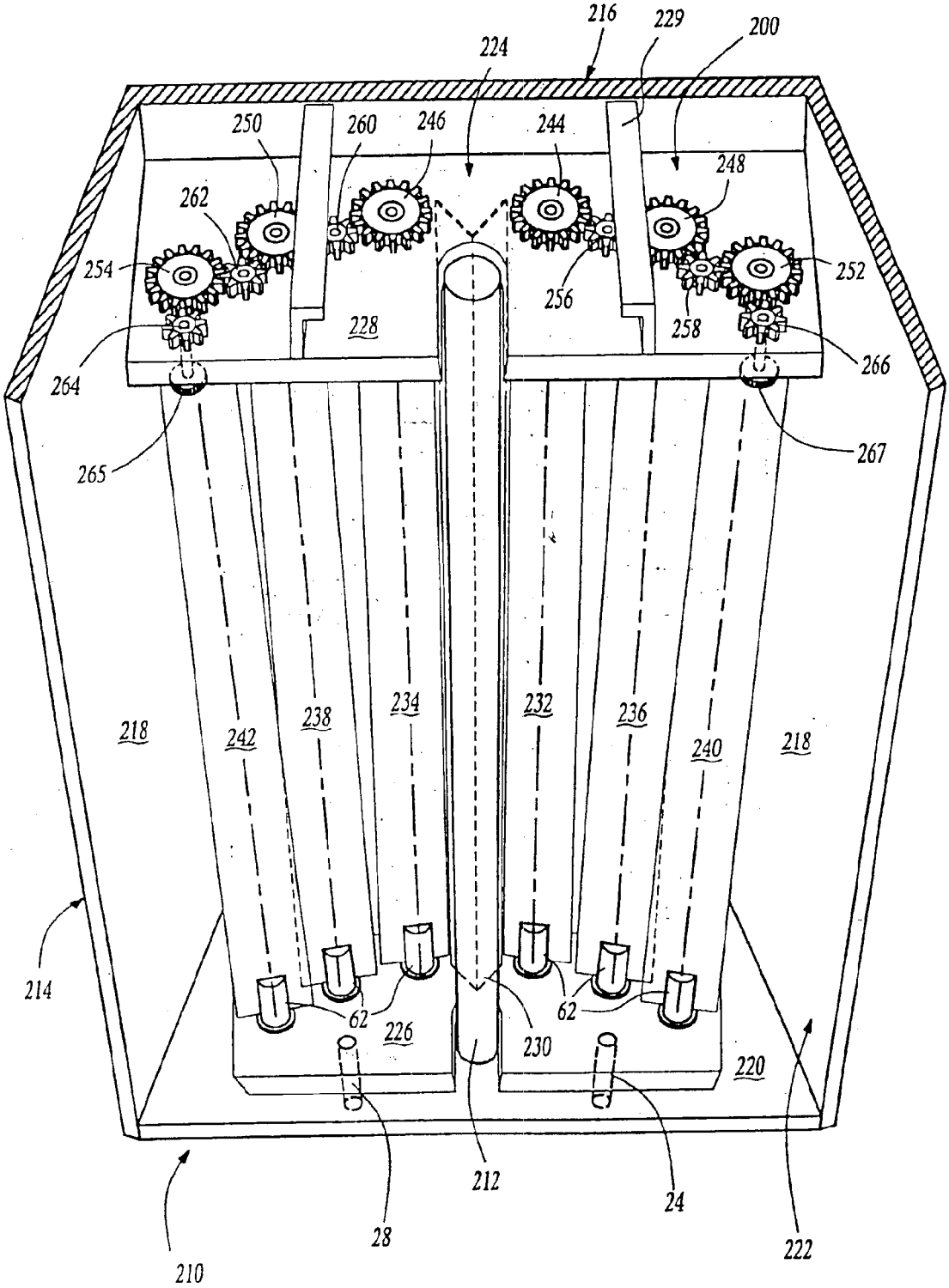
FIG. 10 is a perspective view of a reflector assembly according to the present invention mounted in a luminaire body with a portion of the luminaire body cut away to show the adjustment mechanism.

Referring now to FIG. 10, a second preferred embodiment of the present invention is shown. In this embodiment, the invention comprises a reflector assembly 200 which is designed to reflect light from a bulb 212 in a luminaire 210. This embodiment differs from the earlier embodiment in that the bulb 212 is directly supported by the luminaire 210 rather than by the reflector assembly 200. The reflector assembly 200 of this embodiment can therefore be retrofit to an existing luminaire without modifying the bulb mounting wiring and position. Alternatively, the reflector assembly 200 can be used as part of a new luminaire.

The luminaire 210 has a body 214 made up of a top 216 and a pair of sides 218 which extend between a first end 220 and a second end 221 of the luminaire 210. The sides 218 define an opening 222 for permitting a beam of light to be emitted. The light emitted from the luminaire is made up of two parts, a direct light beam and a reflected light beam. The direct light beam is formed by the light which radiates directly from the bulb 212 out through the opening 222. The bulb 212 radiates in other directions as well and it is the function of the reflector assembly 200 to reflect this light back through the opening 222 as a reflected light beam. The luminaire 210 supports the bulb 212 in the body 214 between the opening 222 and the top 216. The second end 221 of the luminaire 210 has been removed in FIG. 10 to more clearly illustrate the invention.

The reflector assembly 200 includes a reflector support unit 224 which includes a first end 226 and a second end 228. The reflector support unit 224 is configured to be mounted within the body 214 of the luminaire 210 between the opening 222 and the top 216. When installed in the luminaire body 214, the first end 226 of the reflector support unit 224 is adjacent the first end 220 of the luminaire body 214 and the second end 228 of the reflector support unit 224 is adjacent the second end 221 of the luminaire body 214. The ends 226 and 228 of the support unit 224 are designed to be interconnected with the adjacent ends 220 and 221 of the luminaire body 214 so that each end 226 and 228 of the reflector support unit 224 is independently, vertically adjustable in a linear direction so as to adjust the distance between each end, 226 and 228, of the support unit 224 and the opening 222 of the luminaire body 214. By adjusting the distance between the reflector support unit 224 and the opening 222 of the luminaire body 214, the shape of the reflected light beam emitted from the luminaire 210 can be adjusted as was shown in FIGS. 3*a* and 3*b*. In this embodiment, the direct light beam projecting downward from the bulb 212 will not be affected by repositioning the reflector support unit 224. However, the reflected light beam from the reflector assembly 200 will be affected by repositioning the support unit 224. It is also possible to mount the reflector assembly 200 within the luminaire body 214 at an angle relative to the opening 222. This may be desirable where the application requires a non-symmetrical reflected beam of light.

The reflector assembly 200 can be mounted within the luminaire body 214 in any of a number of ways as will be clear to one of skill in the art. As was discussed earlier and illustrated in FIG. 1, bolts 28 which engage threaded apertures 24 may be used. This approach is also illustrated in FIG. 10 which shows the first end 226 of the support unit 224 being interconnected with the first end 220 of the luminaire body 214 using bolts 28 which engage threaded apertures 24. A plurality of threaded apertures 24 may be provided in the ends 220 and 221 of the luminaire body 214 to allow for adjustment in the position of the reflector assembly 200.

An alternative approach is shown with the second end 228 of the support end 224. On this end, support brackets 229 are shown attached to the second end 228 of the support unit 224. The support brackets 229 can serve a variety of functions. First, the support brackets 229 support the second end 228 in an offset position from the second end 221 of the luminaire body 214 so as to provide clearance for an adjustment mechanism, such as the one discussed below. Secondly, the support brackets 229 provide a means to interconnect the end 221 of the luminaire body 214 with the end 228 of the support unit 224. Depending on the application, especially where a retrofit is contemplated, it may be necessary to adapt the luminaire body 214 so that the reflector assembly 200 can be supported therein. Support brackets 229 of various sizes and shapes can be used to adapt the luminaire body 214. The support brackets 229 would first be mounted to the inside of the end 221 of the luminaire body 214 using screws or bolts or other connection means. The brackets 229 would then provide a variety of attachment points for interconnection with the end 228 of the support unit 224 thereby allowing adjustment in the position of the connector assembly 200.

Other interconnection means are also possible. For example, rivets may be used to interconnect the ends 226 or 228 of the support unit 224 with the ends 220 or 221 of the luminaire body where easy adjustment of the position of the reflector assembly 200 is not required. This would simply require drilling a hole through the end 226 or 228 of the support unit 224 and through the end 220 or 221 of the luminaire body 214 and using a rivet to interconnect the two holes. Rivets could also be used to connect a bracket 229 to either the luminaire body 214 or the support unit 224. Alternatively, support unit 224 may include tabs which extend outwardly from the ends 226 and 228. The luminaire body 214 may include holes, or holes may be added, so that the tabs on the support unit 224 may engage the holes in the body 214 of the luminaire 210. Yet other interconnection means are also possible as will be clear to one of skill in the art. This includes gluing or welding the support unit 224 to the body 214 or ultrasonically welding the two together if they are plastic.

The reflector assembly 200 also includes one or more reflectors. In the illustrated embodiment, the reflector assembly 200 includes a fixed center reflector 230 positioned directly above the bulb 212. For purposes of description, a central plane is defined as longitudinally bisecting the support unit 224 such that it passes through the opening 222 of the luminaire body 214 when the support unit 224 is mounted within the luminaire body 214. The central plane longitudinally bisects the reflector support unit 224 such that the longitudinal axis of the bulb 212 and the longitudinal axis of the fixed center reflector 230 are contained within the central plane. Using the central plane as a reference, three reflectors are positioned on each side of the central plane. On one side of the central plane is a first reflector 232, a third reflector 236 and a fifth reflector 240. On the other side of the central plane, and symmetrical with the other three reflectors, 232, 236, and 240, are a second reflector 234, a fourth reflector 238, and a sixth reflector 242. Alternatively, the reflector assembly 200 may include fewer or a greater number of reflectors. Also, the reflectors may have two or more sides as shown in FIGS. 7 and 8. The reflectors may have either a specular or diffuse surface and may be flat, concave, or convex depending on the application.

Like in the earlier described embodiments, the reflectors 232–242 are pivotally mounted to the support unit 224 such that each reflector can pivot with respect to the support unit about its own longitudinal axis. Further, the reflectors 232–242 are preferably detachably mounted to the reflector support unit. A preferred approach for interconnecting reflectors and the reflector support assembly 224 was discussed earlier and shown in FIG. 4*a*.

Referring back to FIGS. 4*a* and 6, details of one preferred approach to supporting the reflectors 232–242 is illustrated. Each end of the reflectors are mounted to a mount 62. The mount 62 includes a flange 68 for mounting an end of a reflector. The reflectors have holes 104 which align with holes in the flange 68 and accept screws 105 for holding the reflectors to the mount 62. The mount 62 also includes a shaft 66 extending from the flange 68. Referring also to FIG. 10, the shafts 66 of the mounts 62 pass through holes in the ends 226 and 228 of the reflector support unit 224. In this way, the reflectors 232–242 are supported for pivotal movement. Adjustment gear wheels are mounted to the mount 62 at the end of the shafts 66 opposite the flanges 68 at one end of the reflectors 232–242. In this way, the position of each adjustment gear wheel determines the pivotal position of each reflector.

Figure 11:
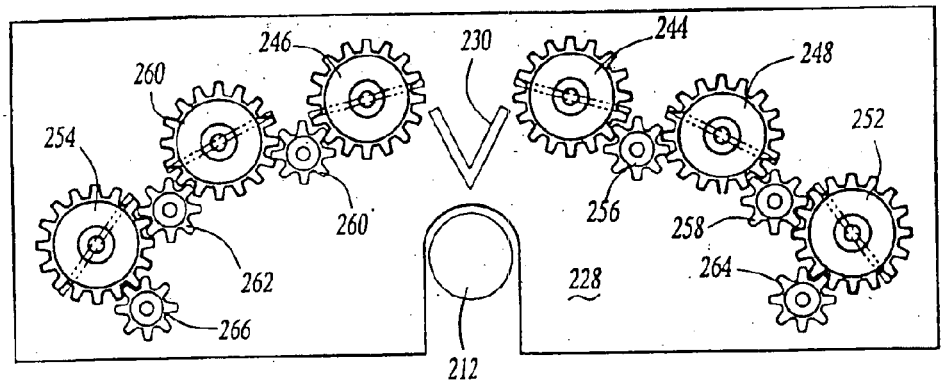
FIG. 11 is an end view of a reflector assembly according to the present invention showing one embodiment of an adjustment mechanism for the pivotally mounted reflectors.
Figure 12:
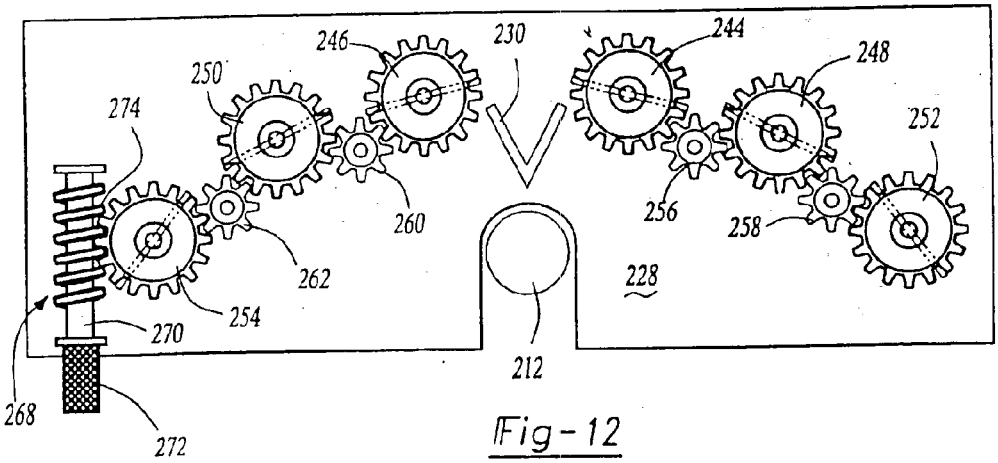
FIG. 12 is an end view of a reflector assembly according to the present invention having a different adjustment mechanism.

Several different adjustment mechanisms are envisioned with the ones illustrated in FIGS. 10, 11, and 12 being preferred. As discussed above, adjustment gear wheels are interconnected with the reflectors 232–242 by the mounts 62. A first adjustment gear wheel 244 controls the first reflector 232, a second adjustment gear wheel 246 controls the second reflector 234, a third adjustment gear wheel 248 controls the third reflector 236, a fourth adjustment gear wheel 250 controls a fourth reflector 238, a fifth adjustment gear wheel 252 controls the fifth reflector 240, and a sixth adjustment gear wheel 254 controls the sixth reflector 242. The adjustment mechanism also includes coordinating gears which mesh with and interconnect the adjustment gear wheels so that the adjustment gear wheels, and the reflectors, move in a coordinated manner. A first coordinating gear 256 is positioned adjacent and engages both the first and the third adjustment gear wheels 244 and 248 so that the first coordinating gear 256 and the first and third adjustment gear wheels, 244 and 248, rotate together. Likewise, a second coordinating gear 258 is positioned adjacent and engages both the third adjustment gear wheel 248 and the fifth adjustment gear wheel 252. A third coordinating gear wheel 260 and a fourth coordinating gear wheel 262 likewise engage the adjustment gear wheels 246, 250, 254 on the other side of the luminaire thereby coordinating their movement.

Figure 21:
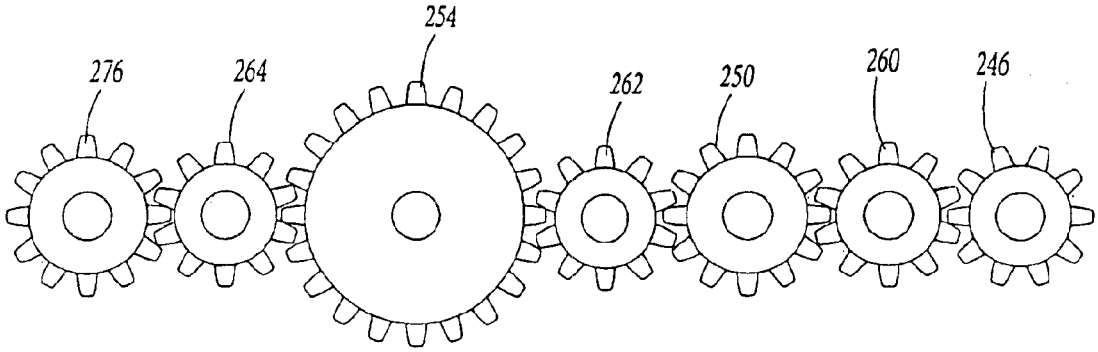
FIG. 21 is a view of adjustment and coordinating gears showing the variation in diameter.
Figure 22:
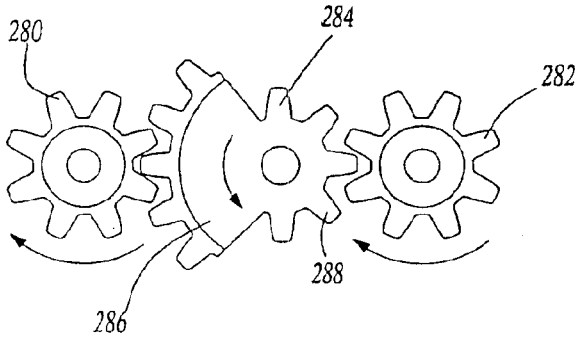
FIG. 22 is a view of two adjustment gears and an alternative coordinating gear.

As shown, the adjustment gear wheels 244–254 are each identical in size to each other. The coordinating gears 256–262 are also identical in size to each other but are smaller in size than the adjustment gear wheels 244–254. With this configuration, the first, third, and fifth, 232, 236, 240, reflectors all rotate an identical amount when any one of them is turned. Alternatively, the sizes of the adjustment gear wheels 244–254 and the coordinating gears 256–262 may be adjusted so that various reflectors turn by different amount. It is desired that the gear sizes be chosen such that the reflectors nearest the bulb rotate less than the reflectors further from the bulb. In one preferred arrangement, for a given amount of adjustment, the reflector nearest the bulb rotates half the amount of the reflector second from the bulb which in turn rotates half as much as the reflector furthest from the bulb. For example, for a given adjustment of drive gear 266, reflector 232 will rotate 5 degrees, reflector 236 will rotate 10 degrees, and reflector 240 will rotate 20 degrees. The actual ratios of the gear sizes will depend upon the desired reflection pattern and the application of the luminaire. The variation in rotation ratios for a given adjustment can be achieved in several ways as will be clear to one of skill in the art. For example, the adjustment gear wheels 244–254 may be of different diameters so as to achieve different amounts of rotation for the various reflectors. One particularly preferred embodiment of this approach is illustrated in FIG. 21. This figure adopts the numbering as used on the coordinating gears and adjustment gears on the left half of the luminaire 210 in FIG. 10. However, for ease of illustration, the gears are arranged in a straight line. Depending on packaging constraints, the gears may be moved out of the straight line configuration. In FIG. 21, a knob gear 276 is connected to an adjustment knob (not shown) and has twelve teeth. Knob gear 276 drives the drive gear 264 which has ten teeth. It in turn drives the sixth adjustment gear wheel 254 having 20 teeth which in turn drives the fourth coordinating gear 262 having ten teeth, which drives the fourth adjustment gear wheel 250 having twelve teeth, which in turn drives the third coordinating gear 260 having ten teeth, which in turn drives the second adjustment gear wheel 246 having ten teeth. Obviously, reflectors attached to the adjustment gear wheels 254, 250, 246 rotate by differing amounts when the knob gear 276 is rotated. By varying the diameter and number of teeth on the adjustment gear wheels 254, 250, 246, the rotation ratios may be selected. Alternatively, the coordinating gears may have different gear ratios on each of their sides so that the adjustment gear wheels which mesh with the coordinating gear turn by different amounts depending on which side of the coordinating gear engages them. This may be achieved by forming the coordinating gear as two half-gears of different diameters as shown in FIG. 22. In FIG. 22, a left adjustment gear wheel 280 and a right adjustment gear wheel 282 both mesh with an intermediate coordinating gear 284 positioned therebetween. As shown, the intermediate coordinating gear 284 has a large diameter portion 286 and a small diameter portion 288 as if the intermediate coordinating gear 284 is formed with pieces of a large diameter gear and a small diameter gear. The intermediate coordinating gear 284 is arranged such that the large diameter portion 286 meshes with the left adjustment gear wheel 280 while the small diameter portion 288 meshes with the right adjustment gear wheel 282. Therefore, for a given rotation of the left adjustment gear wheel 280, the right adjustment gear wheel 282 rotates by a lesser amount but in the same direction as the left adjustment gear wheel 280. Alternatively, the coordinating gears may be made up of a pair of stacked gears with one of the stacked gears engaging one adjustment gear wheel and the other stacked gear engaging the other adjustment gear wheel. Obviously, these various approaches to varying the rotation ratios may also be combined to provide further flexibility.

Also shown in FIGS. 10 and 11, are drive gears 264 and 266 which engage the outermost adjustment gear wheels 254 and 252 respectively. These drive gears are used to adjust the entire adjustment mechanism. For example, the drive gears 264 and 266 may be accessed from below the luminaire 210 and rotated thereby adjusting the position of the reflectors 232–242. The drive gears 264 and 266 are each connected to a knob 265, 267 similar to the one shown in FIG. 6 at 101. A shaft extends from each of the drive gears 264, 266 through the end 228 of the support unit 224 and each has the knob 265, 267 mounted on the inside of the second end 228 of the support unit 224. This allows adjustment of the position of the reflectors 232–242 from inside the luminaire opening 222. A spring may be positioned under the knob to lock the mechanism to avoid movement. Other locking means may also be used.

Referring now to FIG. 12, the worm drive adjuster 268 is substituted for the drive gears 264 and 266. The worm drive adjuster comprises a vertical shaft 270 with a knob 272 on one end and a worm drive gear 274 on its other end. The worm drive gear 274 engages adjustment gear wheel 254 so that the position of the reflectors may be adjusted by rotating knob 272. A second worm drive adjuster may be included on the other side of the reflector support unit to adjust the reflectors on the other side or additional gears may be added so as to interconnect the adjustment gear wheels on each side of the reflector support unit. Alternatively, a longer shaft with several worm drive gears may be used to engage several adjustment gear wheels similar to the approach shown in FIG. 5. As will be clear to one of skill in the art, many other variations on the adjustment mechanism are possible. For example, the adjustment gear wheels may include stops which prevent their rotation beyond a certain position so that the end user of the reflector assembly 200 cannot adjust the reflectors beyond their operating range.

Figure 15:
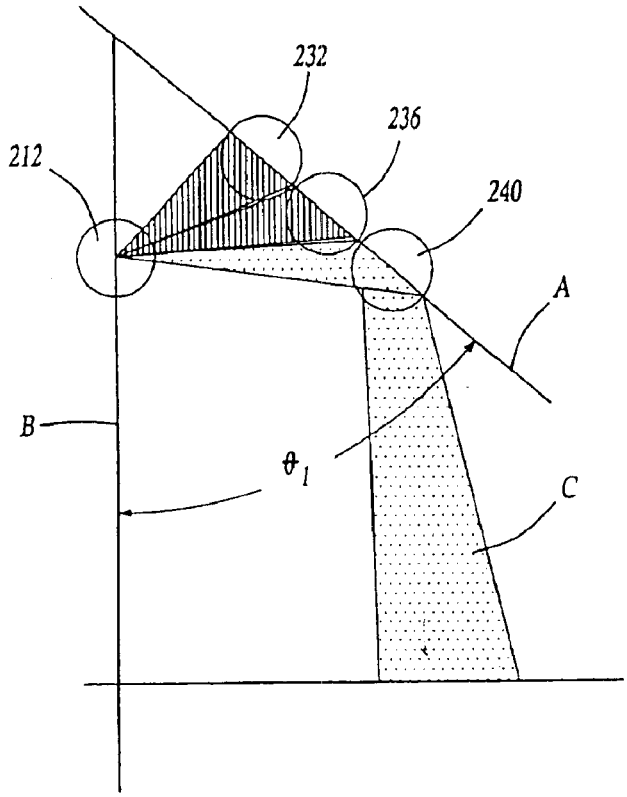
FIG. 15 is a diagram showing light being reflected from reflectors located in a plane positioned such that the reflector assembly creates a narrow reflected light beam.
Figure 16:
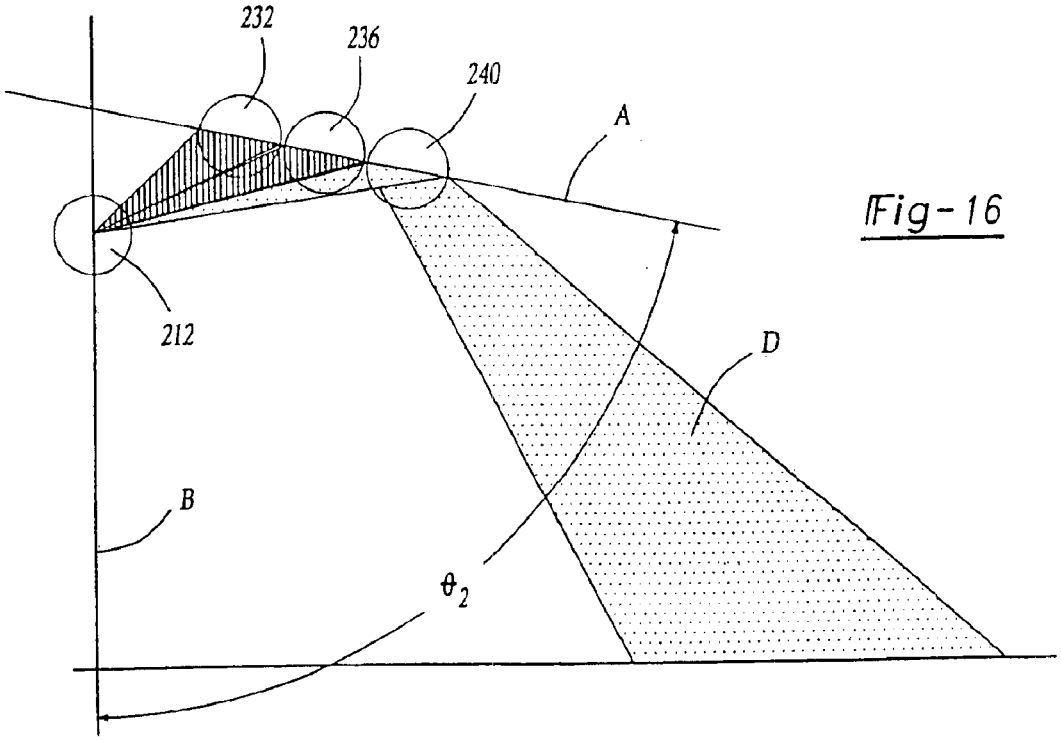
FIG. 16 is a diagram showing reflectors located in a plane positioned such that the reflector assembly creates a wide reflected beam.

Referring now to FIGS. 15 and 16, the effect of reflector positioning is illustrated. In FIG. 15, light is shown radiating from a fluorescent bulb 212 and being reflected from the first, third, and fifth reflectors, 232, 236, 240. The reflectors each have their longitudinal axis located in a plane A which is defined as a first reflector plane. The central plane, discussed earlier, is shown as a vertical line containing the longitudinal axis of the fluorescent bulb 212 and is marked as B. The first reflector plane and the central plane B intersect to define a line which is parallel to the longitudinal axes of the reflectors 232, 236 and 240. The angle formed between the central plane B and the first reflector plane A is defined as a first mounting angle and is illustrated in FIG. 15 as $\theta_1$. Referring now to FIG. 16, the reflectors 232, 236 and 240 are once again shown reflecting light emanating from the fluorescent bulb 212. However, in this case, the first reflector plane A is repositioned so that first mounting angle $\theta_2$ is much larger than first mounting angle $\theta_1$ in FIG. 15. As shown in the figures, the direction and the width of reflected beams are changed. Beam C in FIG. 15 and beam D in FIG. 16 illustrate only that portion of the reflected light beam which is reflected from the fifth reflector 240. In FIG. 15, with a narrow first mounting angle $\theta_1$, the reflected beam C is narrow and reflected almost vertically so that it will illuminate an area near to the central plane B. In FIG. 16, the light beam D reflected from the reflector 240 positioned at a wide first mounting angle $\theta_2$ is wider than the beam C and is directed outwardly away from the central plane B. By changing the mounting angle of the reflector assembly of the present invention, the total width of the reflected beams from the reflector assembly can be limited or expanded.

It should be noted that reflector 240 is positioned such that the reflective surface lies in the first reflector plane A and it is assumed that a flat reflective surface is used. If the reflector 240 were rotated counterclockwise, it would no longer intercept as much light from the bulb with some light passing behind the reflector and not being reflected through the opening. Therefore, the position shown for reflector 240 is the furthest counterclockwise position for efficient reflection of light. Also, the distance of beam C from the central plane B is the furthest from the central plane B that light can be reflected using a flat reflective surface lying in the reflector plane A.

As can be seen, the first mounting angle $\theta_1$ or $\theta_2$ controls how wide a beam of light can be reflected from the reflector located on the first reflector plane. Therefore, a reflector assembly with a narrow mounting angle such as $\theta_1$ in FIG. 15 would be limited in how wide of a reflected beam C it can create. A reflector assembly with a wide mounting angle such as $\theta_2$ in FIG. 16 will be able to reflect light in a much wider beam and much further from the central plane B. Depending on the application, different mounting angles are desirable as will be clear to one of skill in the art. Generally, the mounting angle should not be less than 20 degrees or greater than 90 degrees. Also, the reflectors 234, 238, and 242 on the other side of the central plane B are preferably positioned in a second reflector plane which intersects the central plane at a second mounting angle. This second mounting angle may be the same as the first mounting angle or a different angle depending on the application.

Figure 17:
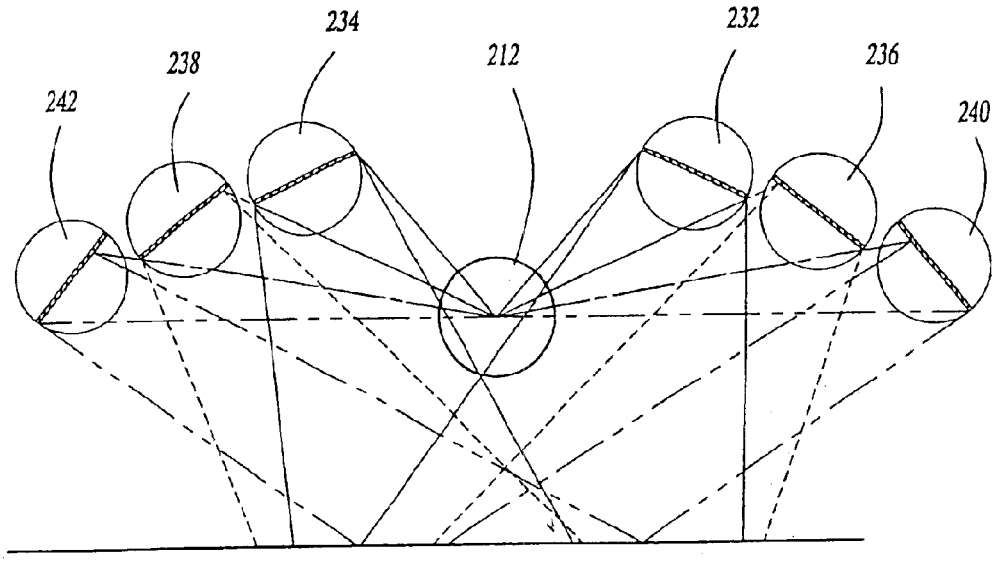
FIG. 17 is a diagram showing light being reflected from a group of reflectors adjusted so as to create a center weighted, focused distribution of light.

Referring now to FIGS. 17–20, a variety of light reflection patterns are shown indicating a variety of patterns which can be created by repositioning the six reflectors 232–242 in the reflector assembly. In FIG. 17, the reflectors 232–242 are positioned such that the reflected beam created by each of the six reflectors is focused on the area directly below the bulb 212. The light reflected from each of the six reflectors also overlaps. This greatly increases the amount of light available in the area directly below the bulb 212. Depending on the configuration, the illumination reflected from each of the reflectors 232–242 is approximately equal to the illumination created by the light radiating directly from the bulb 212. Therefore, by focusing beams created by each of the reflectors 232–242 on the area below the bulb 212, the illumination available directly below the bulb 212 is substantially increased. The pattern created by the reflectors shown in FIG. 17 is called a center weighted, focused distribution of light and is particularly useful where a great deal of illumination is needed in a small area.

Figure 18:
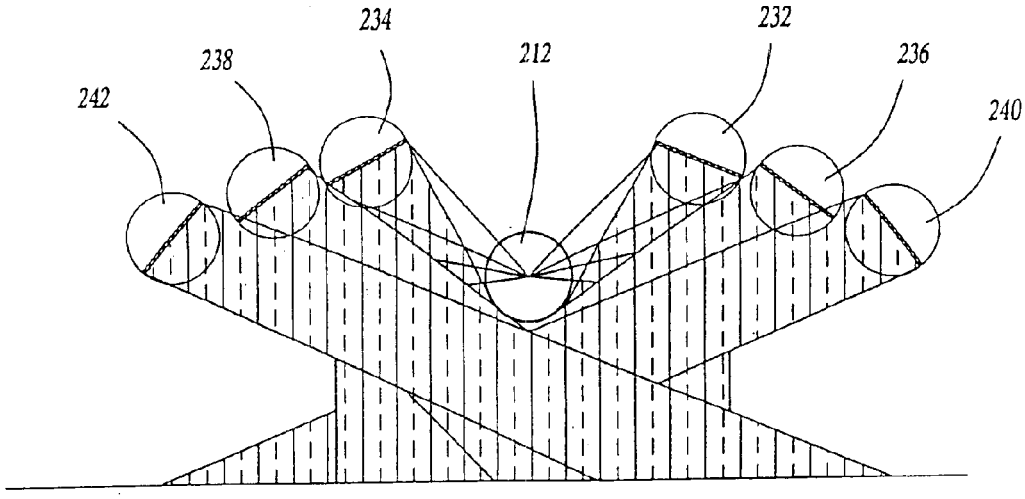
FIG. 18 is a diagram showing light being reflected from a group of reflectors adjusted so as to form a laterally centered distribution of light.

In FIG. 18, the reflectors 232–242 are shown positioned such that the reflected beams of light are more spread out than they were for the position shown in FIG. 17. Once again, the reflected light beams overlap. In this case they are more spread out to form a wider area of increased illumination. This pattern is called a laterally centered distribution of light and is particularly useful where increased illumination is needed in a somewhat larger area than is required for the pattern shown in FIG. 17.

Figure 19:
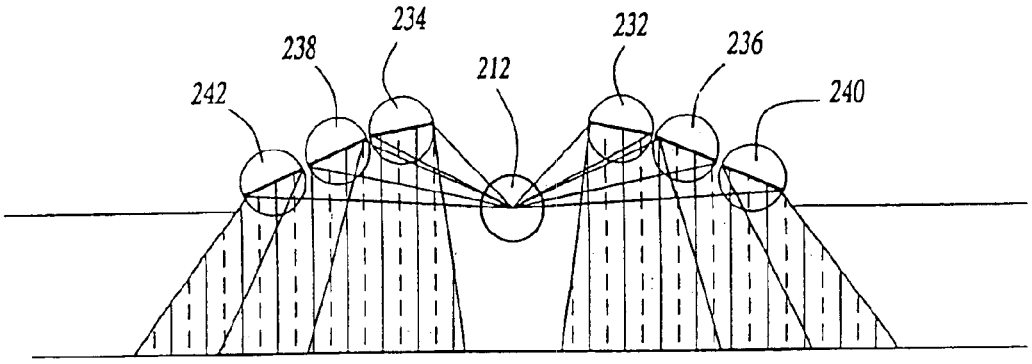
FIG. 19 is a diagram showing light being reflected from a group of reflectors adjusted so as to form a fanned distribution of light.

FIG. 19 shows the reflectors 232–242 positioned such that reflected beams of light are spread out much wider than previously illustrated and the reflected light beams do not significantly overlap. This is a pattern that would be created with the reflective surfaces of the reflectors 232–242 on each side of the bulb 212 positioned in planes much as was shown in FIGS. 15 and 16. As can be seen, the reflected beams do not illuminate the area directly below the bulb 212. This pattern is called a fanned distribution of light and may be useful where a very wide distribution of light is desired or where the area directly below the bulb 212 does not require additional illumination.

Figure 20:
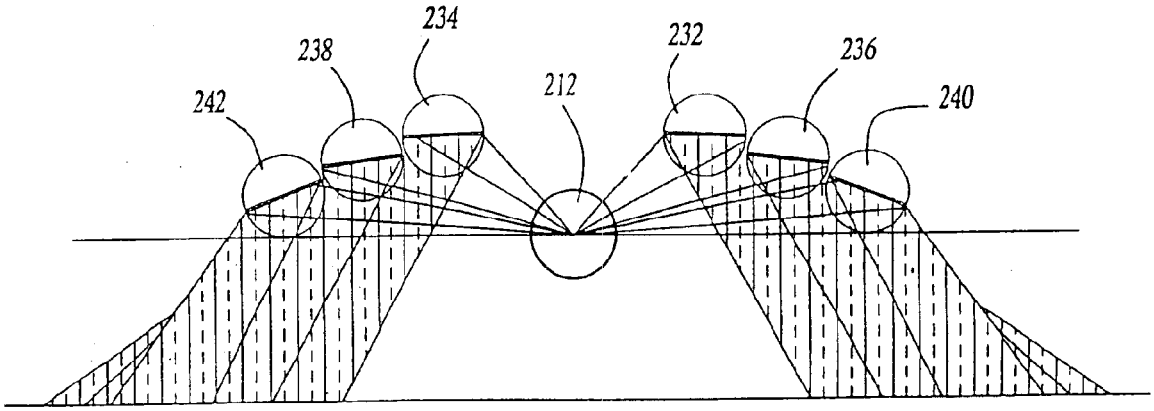
FIG. 20 is a diagram showing light being reflected from a group of reflectors adjusted so as to form a laterally fanned distribution of light.

FIG. 20 shows reflectors 232–242 positioned such that the reflected beams of light are spread even more widely than the pattern shown in FIG. 19. As explained earlier, this positioning allows some light to escape interception by the reflectors and pass behind them. However, this pattern allows for a very wide distribution of light. Depending on the positioning of the individual reflectors, the reflected light beams may overlap so as to create areas of more intense illumination. This pattern is called a laterally fanned distribution of light and is particularly useful where the area below the bulb 212 does not require additional illumination such as if a luminaire is positioned directly above a partition wall.

As will be clear to one of skill in the art, other light patterns may be created by repositioning the reflectors. Also, the above discussed patterns may be combined such that reflectors on one side of the bulb 212 focus light beneath the bulb while the reflectors on the other side of the bulb reflect light away from the location beneath the bulb 212. This may be desirable where the illumination needs are not symmetrical with respect to a luminaire. It should also be noted that the patterns shown in FIGS. 17–20 do not illustrate the light beam directly emitted from the bulb, earlier defined as a direct light beam. The illustrated reflected light beams serve to reinforce the illumination provided by the direct light beam. Therefore, while the direct light beam will tend to provide a uniform level of illumination, the reflected light beams can be used to provide areas of increased illumination where needed.

Figure 23:
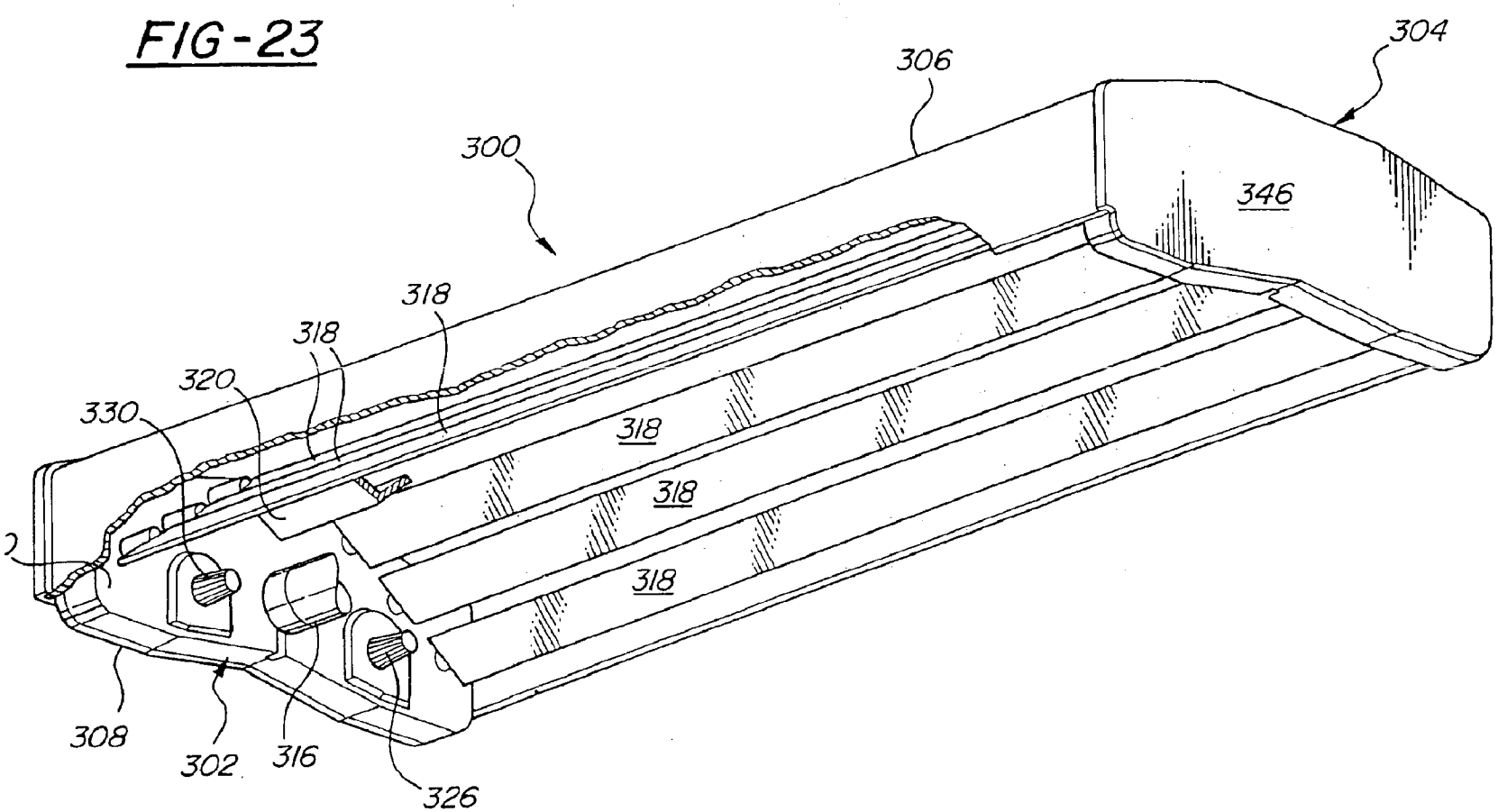
FIG. 23 is a perspective view of a modular luminaire assembled with a pair of modules according to a further aspect of the present invention.
Figure 24:
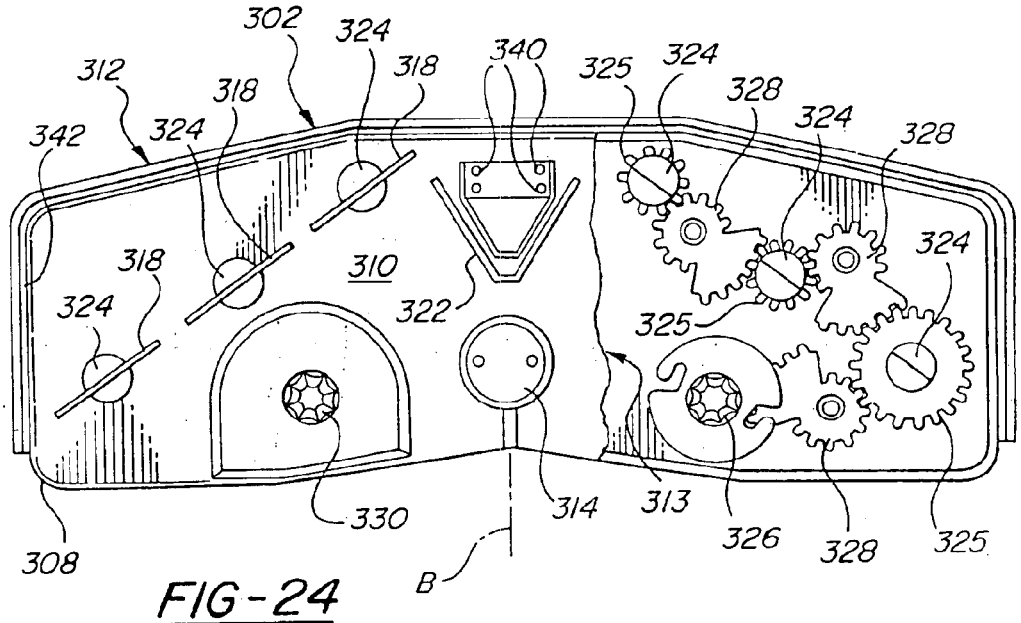
FIG. 24 is an elevational view of the inward surface of one of the modules used in assembling the luminaire of FIG. 23, with a portion of the inward surface cutaway to show the geared reflector adjustor in the module.
Figure 25:
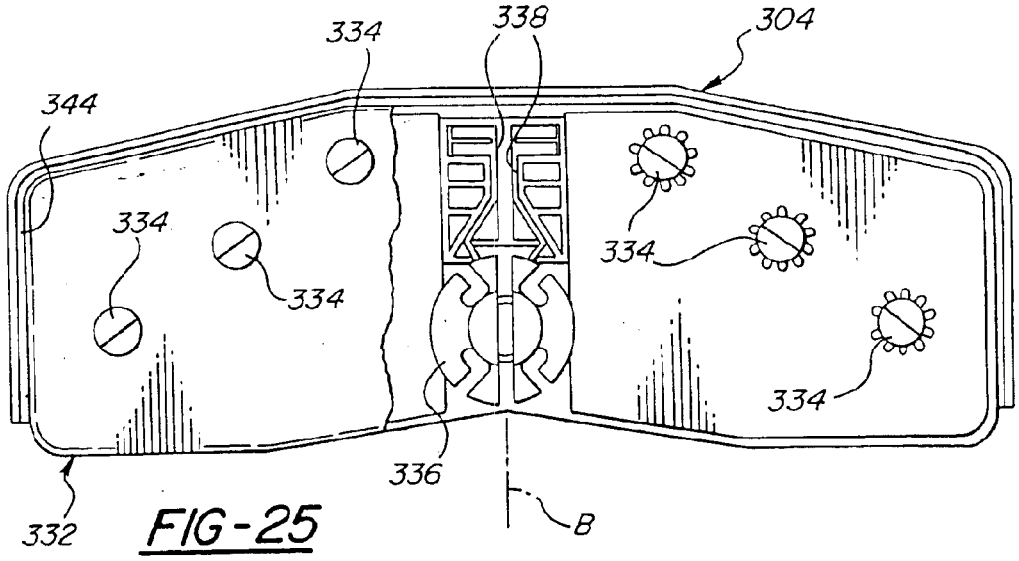
FIG. 25 is an elevational view of the inward surface of the other module used in constructing the luminaire of FIG. 23 with a portion of the inward surface cutaway to show the internal structure.

Referring now to FIGS. 23–25, another aspect of the present invention will be discussed. According to this aspect of the present invention, a modular luminaire 300 is shown. The luminaire 300 includes a first, or master, module 302 that defines a first end of the luminaire 300, a second, or slave, module 304 that defines a second end of the luminaire 300 and an upper luminaire shell 306 that extends between and interconnects the master module 302 and the slave module 304, and also defines the sides and top of the luminaire 300.

The construction of the master module 302 may be best seen in FIG. 24. The module 302 includes a housing 308 which has an inward surface 310 and an opposed outward surface 312 defining a cavity 313 therebetween. The module also has a bulb holder 314 designed to accept one end of a fluorescent bulb 316, part of which is shown in FIG. 23. Alternatively, the housing may have a bulb holder designed to hold a non-fluorescent bulb or a fluorescent bulb with a different design As with previous embodiments of the present invention, the luminaire 300 is designed to have a plurality of adjustable reflectors 318, as shown in FIG. 23. If a central plane B is defined so that it passes through the center of the bulb holder 314 and bisects the housing 308 side to side, the reflectors 318 are arranged generally symmetrically about its central plane and above the bulb holder 314 so that light coming from a bulb 316 is reflected from the plurality of reflectors 318 and downwardly so as to illuminate a surface. Also located on the central plane is a stationary V-shaped reflector 320 that is positioned above the bulb 316 for reflecting light to the adjustable reflectors 316 as well out through the bottom of the luminaire 300. The central V-shaped reflector 320 is supported by a V-shaped support 322 on the inward surface 310 of the housing 308.

Referring to FIG. 24, the adjustable reflectors 318 are each supported by rotatably adjustable reflector holders 324. These reflector holders 324 extend outwardly from within the housing 308, as shown in the cutaway portion on the right hand side of FIG. 24. Within the housing, is a system of gears that coordinate movement of the reflector holders 324. This system of gears, along with an adjustable knob 326 form a system for adjusting the position of the reflector holders 324. The system includes the adjustment knob 326, three intermediate gears 328 and the reflector holders 324 which have adjustment gears 325 mounted at their bases. As shown, the adjustment knob 326 adjusts the reflector holders 324 on the right hand side of the module 302. The second adjustment knob 330 is provided on the left hand side of the module 302 for adjusting the reflector holders 324 on the left hand side. On the left hand side of the drawing, the internal gear system is hidden by the inward surface 310 of the housing 308. As will be clear to those of skill in the art, the gearing system for adjusting the adjustable reflector holders 324 may be modified in various ways so as to change how the reflectors move relative to one another, as has been explained with respect to earlier embodiments of the present invention.

Referring now to FIG. 25, the slave module 304 will be described in more detail. The slave module 304 is similar to the master module 302 but differs in that it lacks an adjustment system for adjusting the position of the reflector holders. The slave module 304 includes a housing 332 and six adjustable reflector holders 334 that are supported by the housing 332. The right side of FIG. 25 is cutaway to show the inside of the housing 332. As shown, the adjustable reflector holders 334 are not interconnected by a gear system, but rather are free to turn. However, to reduce complexity, the holders 334 may be a common part with the holders 324. The slave module 304 is designed to be used with the master module 302 as shown in FIG. 23. The reflectors 318 interconnect the adjustable reflector holders 324 on the master module 302 and the reflector holders 334 on the slave module 304. Depending on the design of the luminaire 300, the reflectors 318 are stiff enough that, when they are rotatably adjusted by the master module 302, the reflector holders 334 on the slave module 304 also turn. That is, a user adjusts the adjustment knobs 330 and 326 on the master module, which in turn adjusts the rotational position of the reflector holders 324, causing the position of the reflectors 318 to be adjusted. The reflector holders 334 in the slave module 304 just support the other end of the reflectors 318 and allow them to rotate freely. As will be clear to those of skill in the art, some embodiments of a luminaire using the modules may require the use of two master modules 302 rather than a master module and a slave module 304. That is, if the luminaire is very long, adjusting only a single end of the very long reflectors 318 may cause them to twist. Therefore it may be necessary to provide adjustment at both ends so that each end of each reflector may be rotated an equal amount to prevent a twisting.

Referring again to FIG. 25, the internal structure of the central portion of the module is shown because the inward surface is cutaway. As shown, a portion of the bulb holder is disposed within the housing and has a rotational support 336 into which the end of the bulb is inserted and twisted. Conducting leads 338 then interconnect the contacts on the bulb with wiring holes 340, as shown in FIG. 24. Wires may be run above the central reflector 320 from one end of the luminaire to the other by interconnecting the wiring holes 340. In this way, power can be run from one end to the other.

Referring now to each of FIGS. 23–25, assembly of the luminaire 300 will be discussed. As shown in FIG. 23, a luminaire shell 306 interconnects the two modules 302 and 304. In FIG. 24, the master module 302 has a groove or slot 342 that follows the upper perimeter of the housing 308. The slave module 304 in FIG. 25 has a similar groove or slot 344 following its upper perimeter. The ends of the upper shell 306 are inserted into these two grooves, connected using any of a variety of mechanical interconnection methods, or adhesively attached. The central reflector 320 and adjustable reflectors 318 may then be attached to form a complete luminaire. In this way, a luminaire 300 is easily assembled and may be formed with any of a variety of lengths by changing the length of the shell 306 and the reflectors 318 and 320. As shown in FIG. 23, the outward surface 346 of the slave module 304 is smooth to give a finished appearance.

Figure 26:
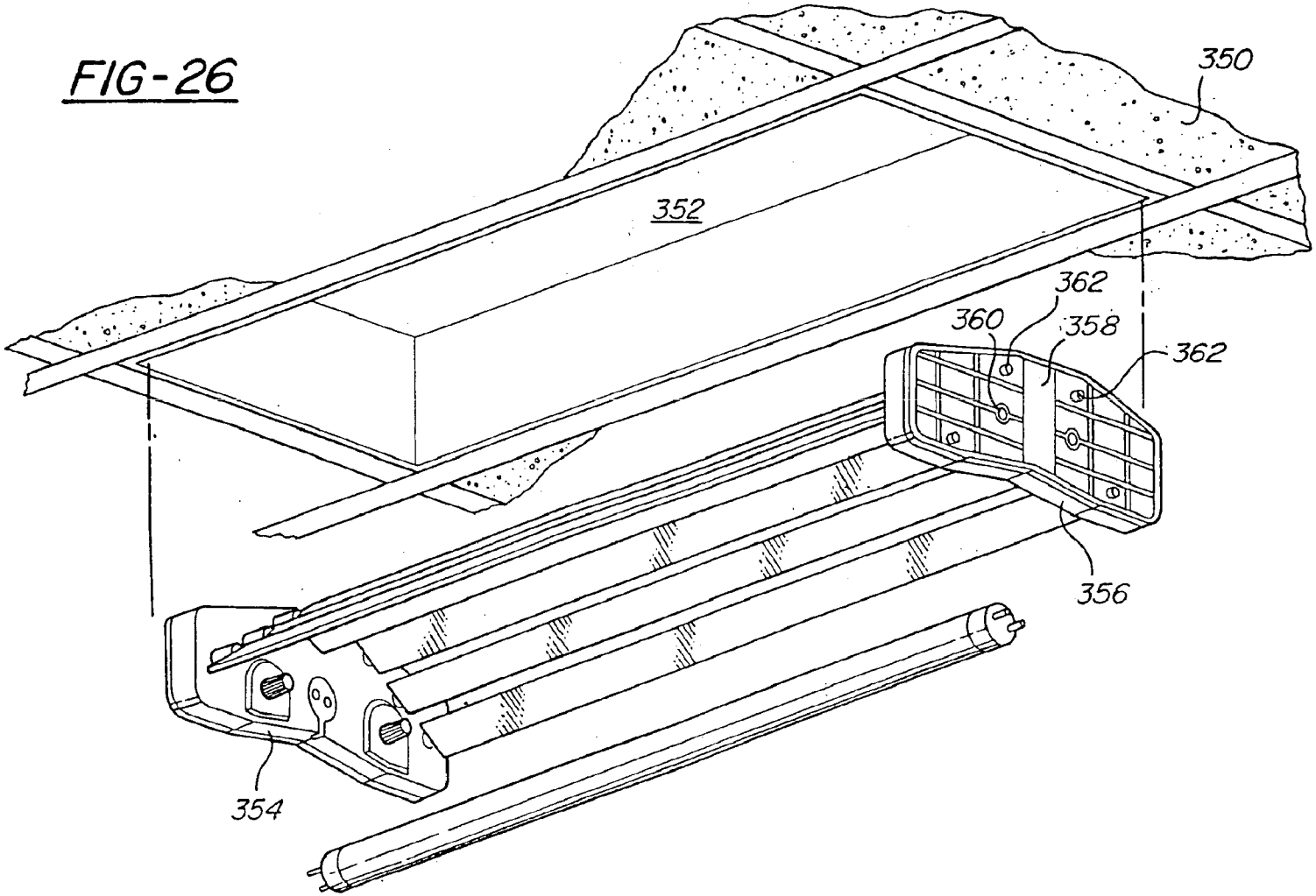
FIG. 26 is a exploded perspective view showing a modular luminaire system according to the present invention being assembled into an opening in a ceiling.

Referring now to FIG. 26, another embodiment of a modular luminaire system is illustrated. In this embodiment, modules are provided that mount within an existing housing or frame within a ceiling of a building so as to provide the benefits of the present adjustable reflector system. As shown, a ceiling 350, such as within an office building, has a recessed housing or frame 352 for a lighting fixture. According to the present invention, a master module 354 and a slave module 356 are provided which will mount within the housing or frame 352. These modules 354 and 356 are identical to the previously discussed modules except that their outward surfaces 358 include a variety of mounting devices for interconnecting each of the modules 354 and 356 with the housing 352. For example, the outward surface 358 of the slave modules 356 is shown to have two attachment holes 360 as well as several attachment pegs 362.

The pegs 362 may be provided and used where the housing has slots or holes which they may engage. Alternatively, the holes 316 may be used with mounting studs or screws. The modules 354 and 356 may be adjustably mounted within the housing 352 or may be placed in a stationary position. As discussed earlier in this application, the pattern of light reflected out of the luminaire can be changed by moving the reflector system upwardly and downwardly relative to the opening in the ceiling 350. If this is desired, the modules 354 and 356 may be adjustably mounted, such as by providing slots to engage the posts 362.

As will be clear to those of skill in the art, many of the parts within the modules are interchangeable therebetween so as to reduce complexity. Also, a single module may be provided that can either be mounted within a luminaire frame, as in FIG. 26 or, alternatively, be mounted to the end of a luminaire shell, as in FIG. 23. In the illustrated embodiment, the difference between a module designed to connect to a luminaire shell and one designed to connect to a luminaire frame are the slots for engaging the shell and the connectors on the outward surface of the module. In one preferred construction of the module, the outward surface is a molded piece of plastic and the inward surface is a second piece of molded plastic that is snapped together when the module is assembled. The piece of plastic forming the outward surface is designed such that it extends beyond the piece of plastic forming the inward surface so as to define the slot or groove that engages the luminaire shell. Alternatively, this outward piece of plastic can extend just to the limits of the inward piece of plastic and include mounting devices such as holes and pegs. In this way, only the outward piece of plastic need be changed to change the module from one design to mount to a shell to one design to mount to a frame. Alternatively, the same module may be used for either application.

Figure 27:
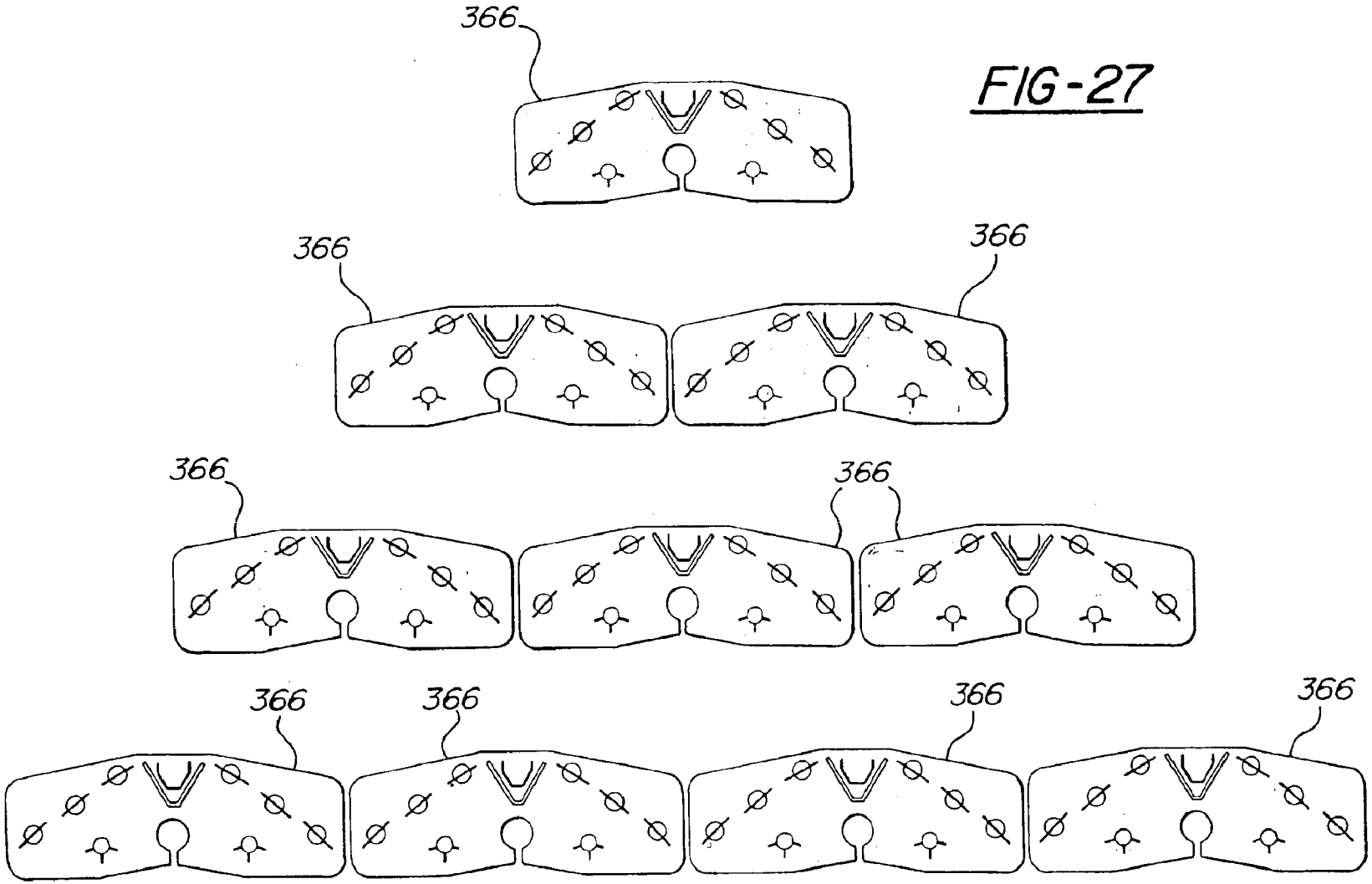
FIG. 27 is a schematic view showing different ways in which modules, each having three rotatably adjustable reflectors on each side of a central stationary reflector, can be combined so as to form luminaires of various sizes.
Figure 28:
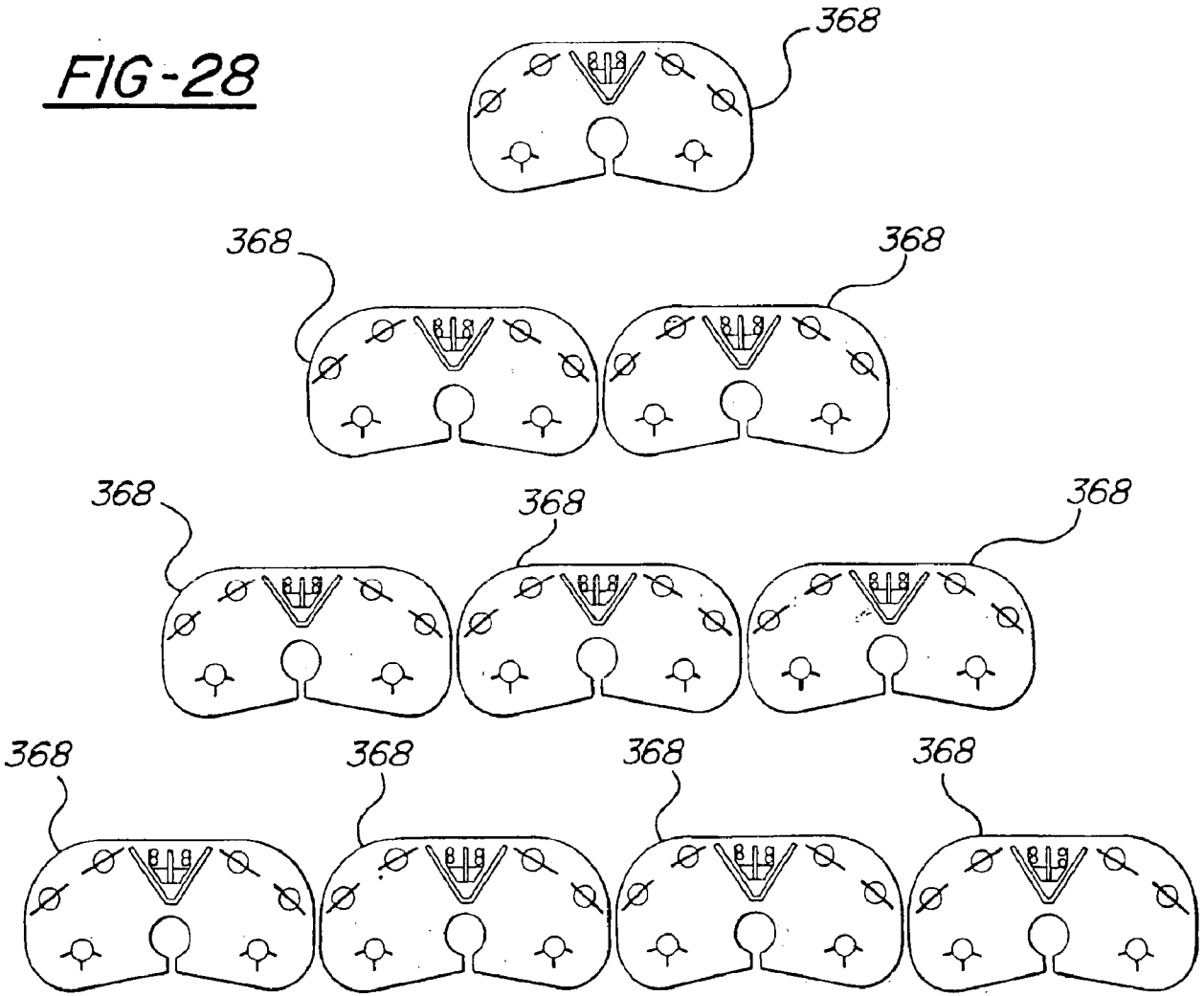
FIG. 28 is a schematic view showing different ways in which modules, each having two rotatably adjustable reflectors on each side of a central stationary reflector, can be combined so as to form luminaires of various sizes.

One advantage to the modules of the previous figures is that they may be combined in various ways so as to provide larger or smaller luminaire arrangements. For example, in FIG. 27, it is shown that a single module with three reflectors on each side of the bulb, as shown at 366, may be used alone to provide a single width luminaire. This is shown at the top of FIG. 27. Below this in FIG. 27, a pair of identical modules 366 are shown side by side to illustrate that a pair of modules may be installed side by side in a larger housing to provide a large luminaire. Likewise, three and four luminaires are shown side by side in the bottom two rows of FIG. 27. In this way, a very large luminaire may be provided while still providing the benefits of adjustable reflector systems. Referring now to FIG. 28, a smaller module 368 with two reflectors on each side of the bulb is shown. As with FIG. 27, a single module 368 or multiple modules may be provided so as to provide a luminaire of different sizes.

Figure 29:
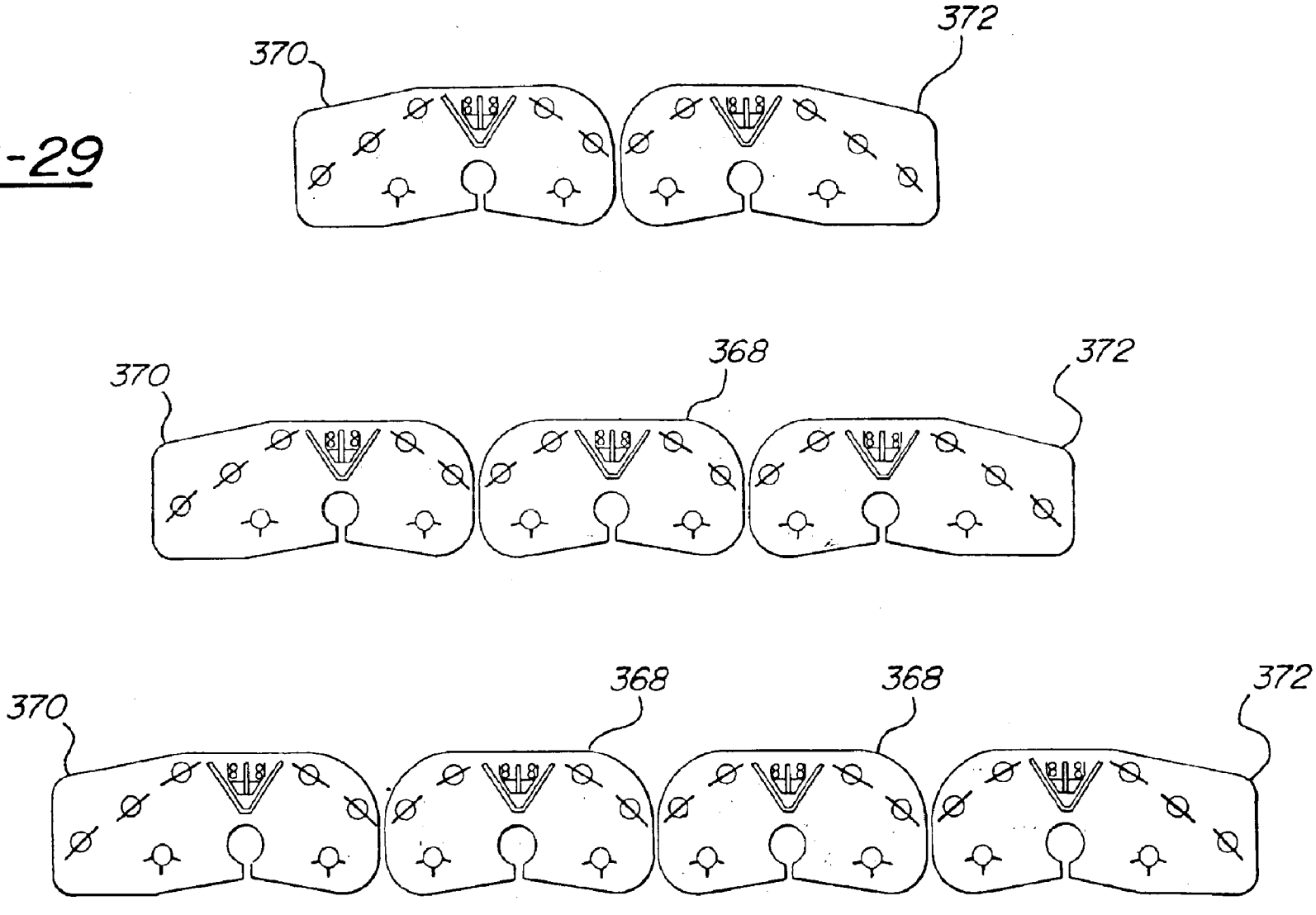
FIG. 29 is a schematic view showing different ways in which modules, some having rotationally adjustable reflectors on one side of a stationary central reflector and two rotatably adjustable reflectors on the other side of the central reflector, can be combined so as to form luminaires of various sizes.

Referring now to FIG. 29, a symmetrical module 370 is shown with three reflectors on one side of the bulb and two on the other side of the bulb. A mirror image symmetrical module 372 may also be provided with two reflectors on one side and three reflectors on the other. By combining these modules 370 and 372, as shown in the first row of FIG. 29, a larger luminaire may be created. As shown in the second row of FIG. 29, a 2+2 module 368 may be combined with the asymmetrical modules 370 and 372 to provide a larger luminaire. Or, as in the third row, two 2+2 modules 368 may be provided in between the asymmetrical modules 370 and 372.

Figure 30:
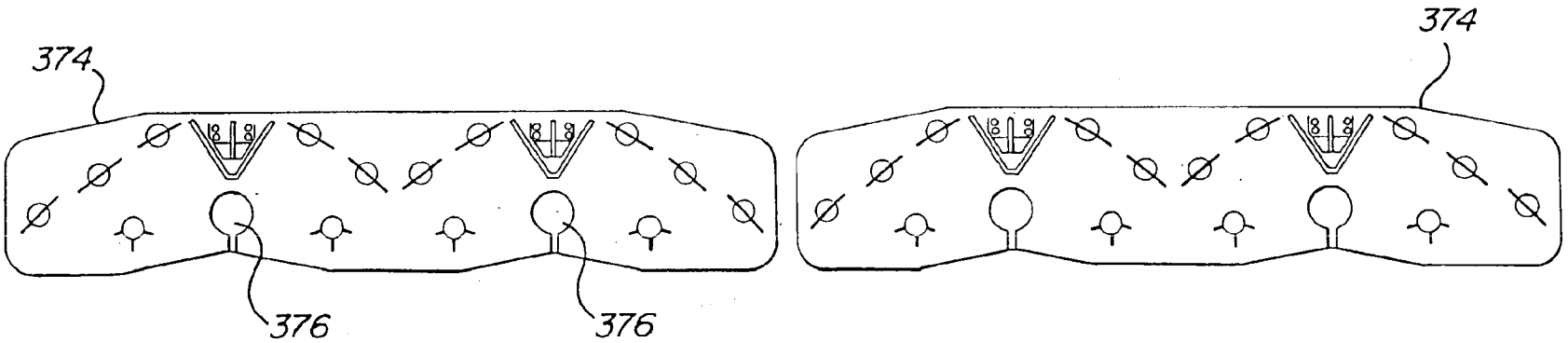
FIG. 30 is a sketch showing a pair of four lamp modules designed for applications requiring large luminaires.

Referring now to FIG. 30, a dual lamp module 374 is shown. This module differs from the prior modules in that it has two lamp holders 376 with reflectors between the lamps and to the outside. A total of four adjustment knobs are provided. A second dual lamp module 374 is also shown to illustrate that two modules may be combined to provide a very large luminaire.

Figure 31:
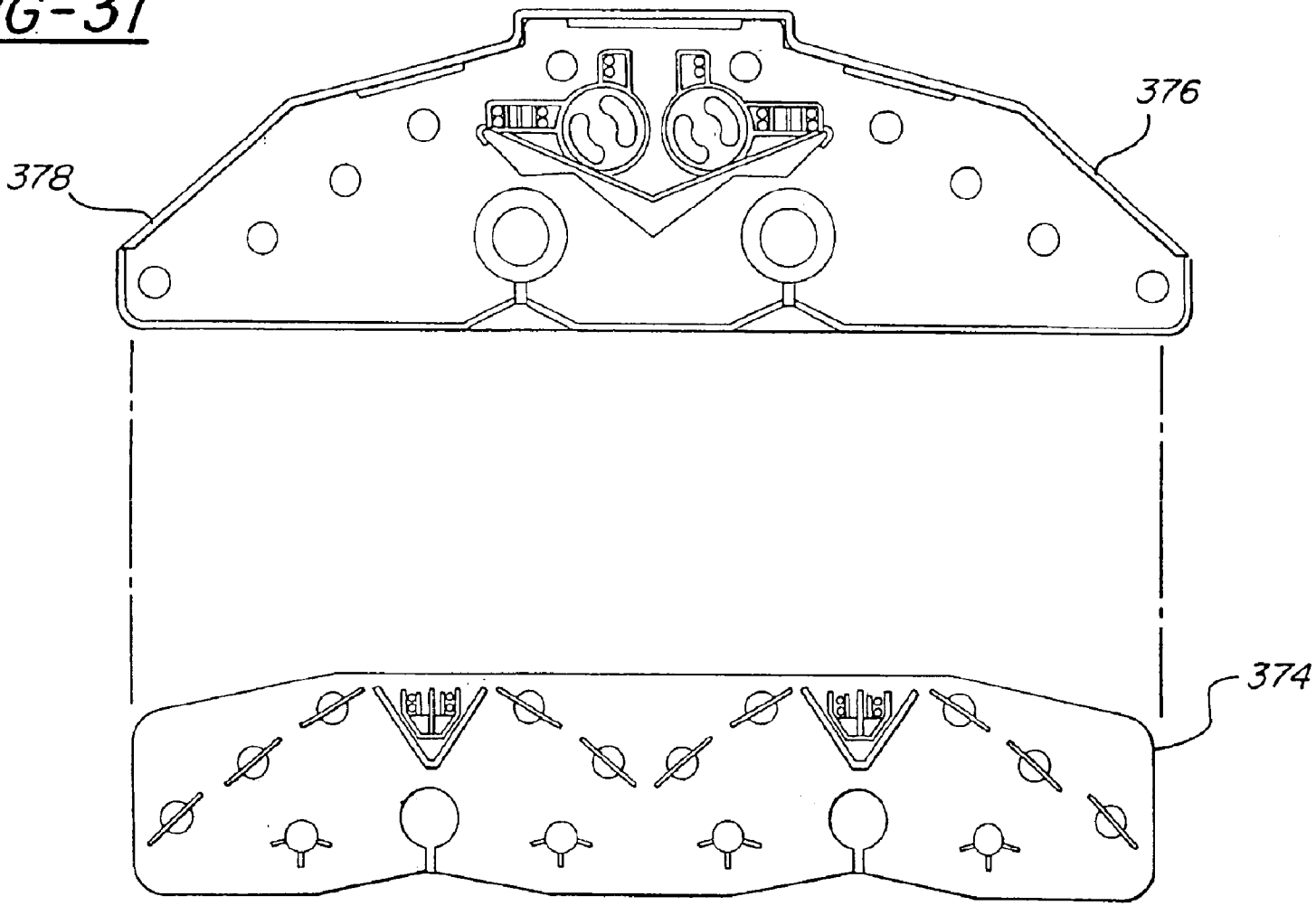
FIG. 31 is a sketch showing a comparison between a module designed for mounting within the larger luminaire housing and a module designed to form the end portion of a self-contained modular luminaire.
Figure 32:
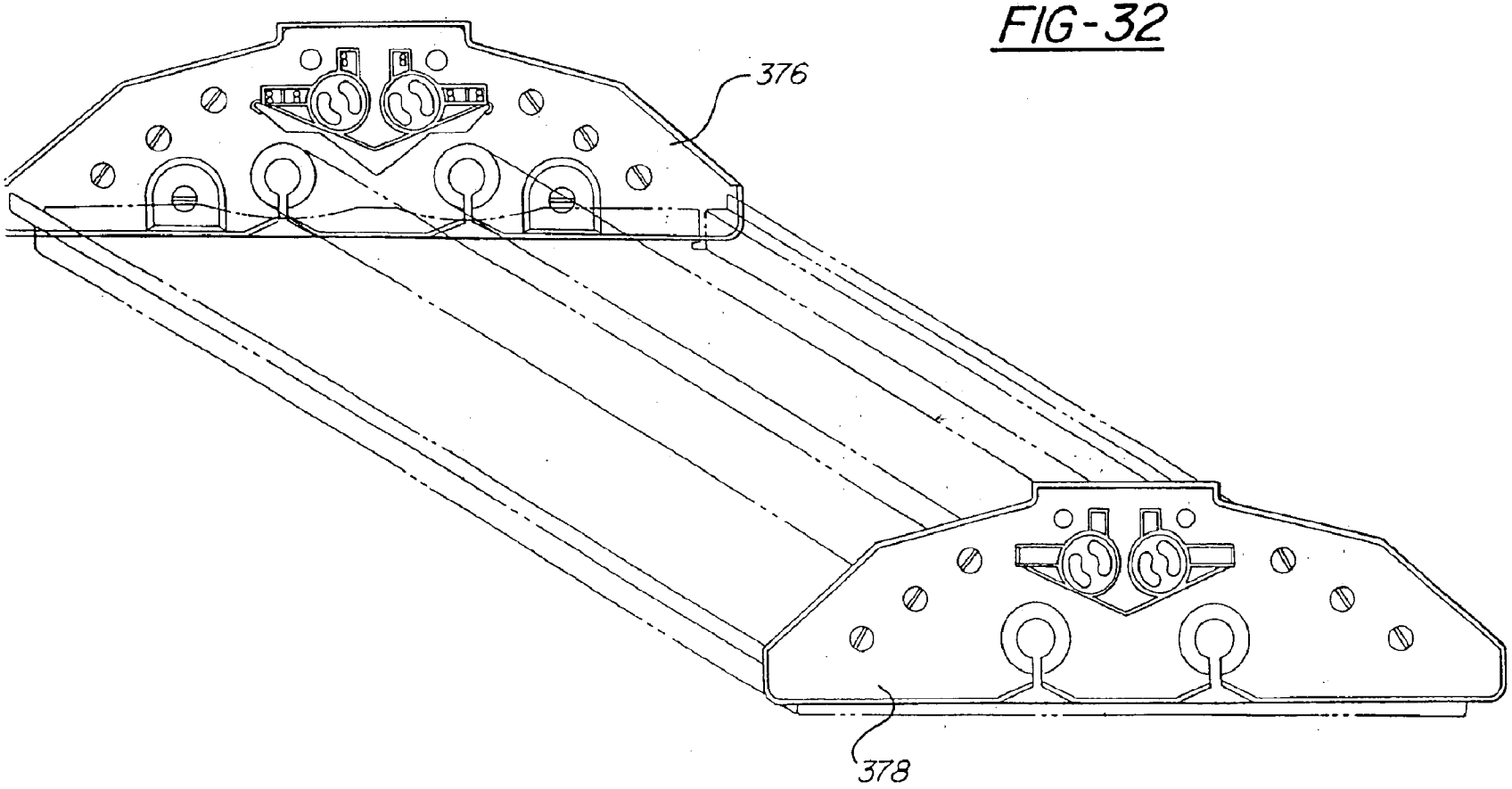
FIG. 32 is a transparent perspective view of an industrial version of luminaires assembled with a pair of modules according to the present invention, with the luminaire shell removed.
Figure 33:
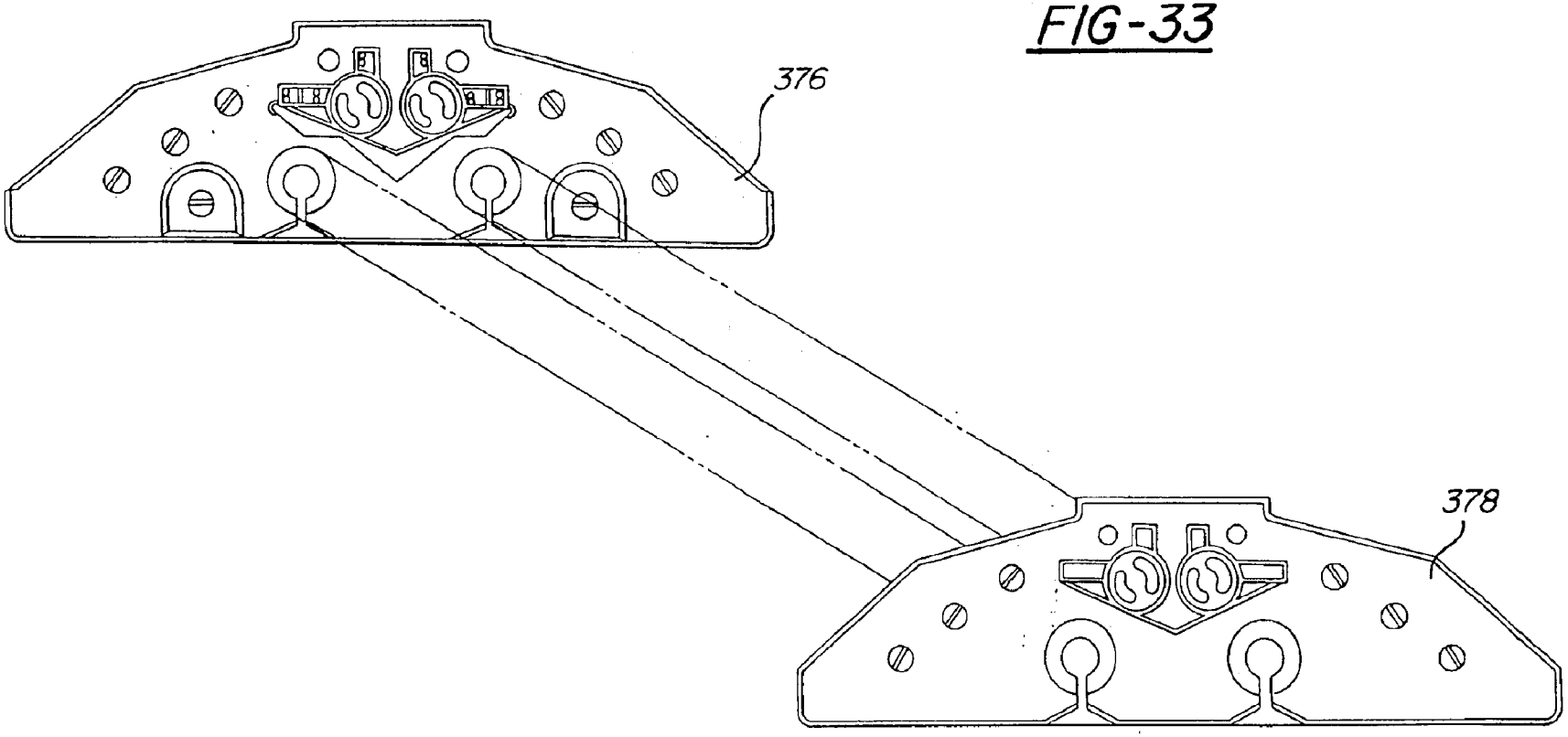
FIG. 33 is a perspective view of the luminaire of FIG. 32, further with the covering for the light opening removed for clarity.
Figure 34:
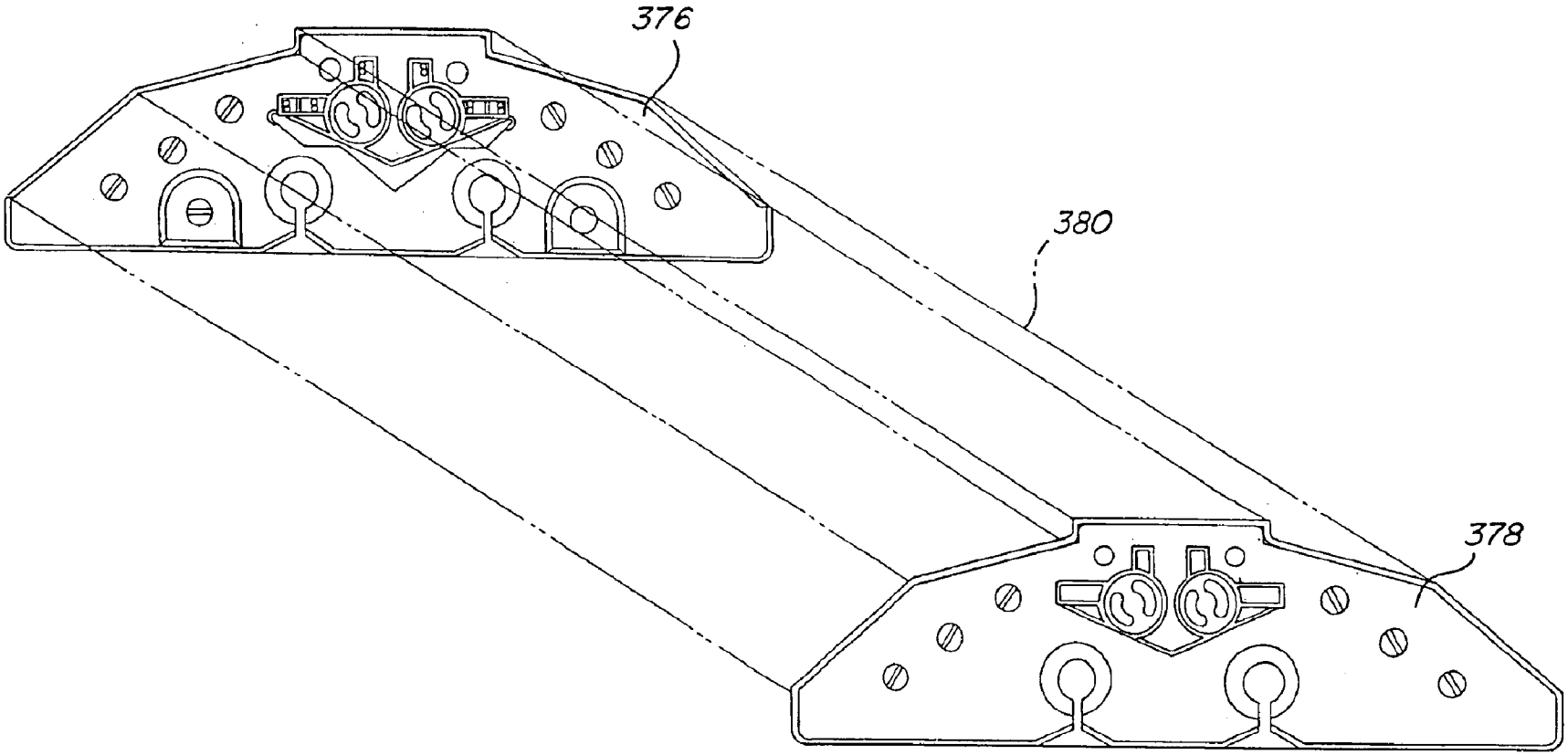
FIG. 34 is a perspective view of the luminaire of FIG. 32 showing just the pair of modules and the luminaire shell.

Referring now to FIG. 31, the two lamp module 374 of FIG. 30 is shown at the bottom. At the top, a different two lamp module 376 is shown. This module 376 is an industrial version that, similar to the modules of FIGS. 24 and 25, is designed to form one end of a luminaire and includes a slot 378 to engage an upper shell. A luminaire assembled with a pair of the industrial modules 376 is shown in FIGS. 32–34. In these figures, two modules 376 and 378 are interconnected by an upper shell 380 to form a complete luminaire. It should be noted that these modules include ballast connectors 382 for connecting a ballast directly to the module. The earlier modules may also be provided with ballast connectors.

As discussed previously, the reflectors in luminaries according to the present invention maybe mounted to mounts by passing a screw through a hole in the end of the reflector and into the mount. This approach is illustrated in FIGS. 4A and 6. According to a further aspect of the present invention, the reflectors can be attached to mounts using quick connect connectors. This allows the luminaries to be more easily assembled and reflectors to be more easily changed. For purposes of this invention, a quick connect connector is defined to be a connector that allows push-together, or snap-together engagement. A screw or a nut and bolt is not considered a quick connect connector for purposes of this invention.

Figure 35:
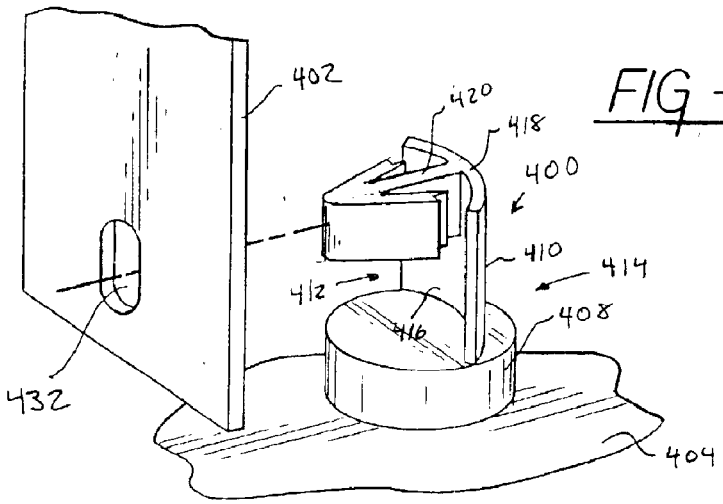
FIG. 35 is a perspective view showing a quick connect reflector holder according to the present invention along with a portion of a reflector positioned for connection to the holder.
Figure 36:
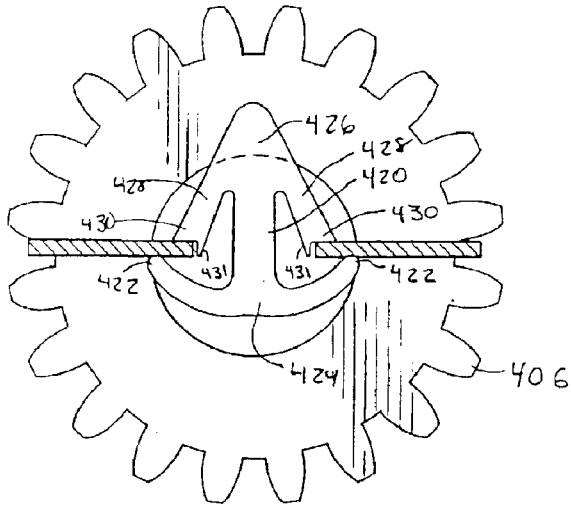
FIG. 36 is a cross-sectional end view of the quick connector reflector holder with a reflector assembly thereon.

Referring now to FIG. 35, a portion of a reflector mount or holder 400 is shown for supporting a reflector 402. The reflector holder is one type of quick connect reflector holder, designed to expedite mounting of the reflector 402 in a luminaire. The reflector holder 400 extends from the housing wall or end wall 404 of a luminaire housing. Preferably, the reflector holder 400 is supported by the housing such that it can rotate or be rotated, as was discussed with earlier embodiments of the present invention. Some embodiments of the reflector holders may include a gear 406, as shown in FIG. 36, for turning the reflector holder. The gear 406 may be positioned on the opposite side of the end wall 404 of the housing, in a hollow area inside the housing, as was shown in FIGS. 24 and 25, or may be used in other ways. Referring again to FIG. 35, the reflector holder 400 has a base 408 that is a short cylinder and extends through the end wall 404 of the housing. A semi-arcuate flange member 410 extends from the base 408 in a direction generally perpendicular to the end wall 404. Basically, if the base 408 is considered to extend vertically upwardly from the end wall 404 of the housing, the flange member 410 may be said to be a wall that extends vertically straight upwardly from the base. The flange member 410 is curved about a vertical axis, such that the flange member has a concave side 412 and a convex side 414. As will be clear to those of skill in the art, the directions, such as vertical and upwardly, are arbitrary, since a luminaire or a reflector holder according to the present invention may be positioned in a variety of orientations.

Figure 37:
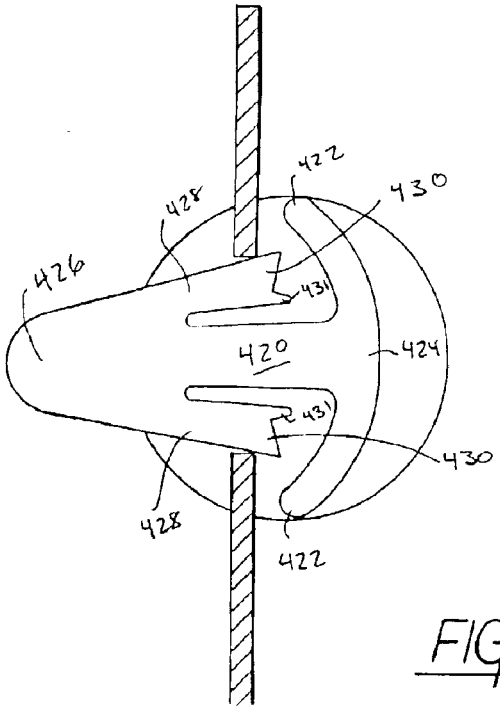
FIG. 37 is a cross-sectional end view of a portion of the quick connector holder with a reflector partially connected therewith.

The flange member 410 may be said to have a first end 416 adjacent the base 408 and a second end 418 away from the base. A connection post 420 extends perpendicularly from the concave side 412 of the second end 418 of the flange member 410. Referring now to FIGS. 36 and 37, the flange member has a pair of edges 422 extending from the first end 416 to the second end 418 of the flange member 410. Viewed in cross section, as shown in FIGS. 36 and 37, the flange member has a dish shaped cross section with the edges 422 forming the rims of the dish. The portion of the flange member 410 between the edges may be termed a mid-portion 424. The connection post 420 extends from the midportion 424 so that it extends out of the "bowl" of the flange member 410. The post has an outward end 426. As shown, two lock ears 428 extend from the outward end 426 of the post and slant towards the two edges 422 of the flange member 410. The outward end of the post 420, along with the lock ears 428, form a pointed end. Together, they form an arrow shape with the post being the shaft of the arrow. The lock ears 428 each have a locking end 430 away from the outward end 426 of the post 420. The locking ends are positioned near the edges 422 of the flange member 410, with a gap defined therebetween. Together, the locking ends 430 cooperate with the edges 422 to hold a reflector, as will be described. Therefore, the locking ends and the edges form the quick connect reflector portion of the present embodiment.

In FIG. 35, the reflector 402 is shown to have a hole 432 defined through an end of the reflector. The hole 432 is shown aligned with the central axis of the post 420, in a ready to connect position. In FIG. 36, the reflector 402 is shown fully installed on the quick connect reflector holder 400. The lock ears 428 engage the hole 432 and force the reflector down against the edges 422 of the semi-arcuate flange member 410.

Referring now to both FIGS. 36 and 37, installation of the reflector 402 onto the reflector holder 400 will be discussed. In FIG. 37, the pointed end of the post 420 and lock ear 428 combination is shown being inserted into the hole 432 in the reflector 402. The locking ends 430 of the lock ears 428 are normally spread wider than the hole 432 in the reflector 402, and are shown being squeezed together in FIG. 37. The reflector holder 400 is preferably formed from a flexible and resilient material such as plastic to allow the lock ears to flex when inserted into a hole. FIG. 36 shows the post and lock ears of the reflector holder inserted fully into the hole 432 in the reflector 402 so that the two are connected together. As shown, the locking ends 430 of the lock ears 428 have a flat surface facing the flange member, and preferably have locking tabs 431 at the inward edges of each of these flat surfaces. Once the post and lock ears of the reflector holder 400 are inserted fully into the reflector 402, the lock ears 428 are able to move outwardly to close to their normal positions with the locking tabs 431 engaging the inside of the hole 432 in the reflector 402. The edges 422 of the semi-arcuate member 410 deflect away from the locking ends 430 as the reflector 402 is pressed against them. Therefore, these outer edges 422 exert a force on the reflector 402 towards the lock ears, thus maintaining the reflector in engagement with the lock ears. As will be clear to those of skill in the art, the previously described quick connect reflector holder provides the advantage that a reflector may be quickly installed onto a reflector holder without the use of additional connectors.

The above described embodiment of a quick connect reflector holder may be altered in various ways. For example, the post and lock ear combination may be replaced with other quick connect features. One type is known as a "Christmas tree" connector and includes a shaft with multiple flanges extending from the shaft such that the shaft may be pressed through a hole and flanges retain the item with the hole. As another alternative, the lock ears may have other forms, such as tabs or bumps extending outwardly. Each of these allows push-together connection between the connector and the reflector.

Figure 38:
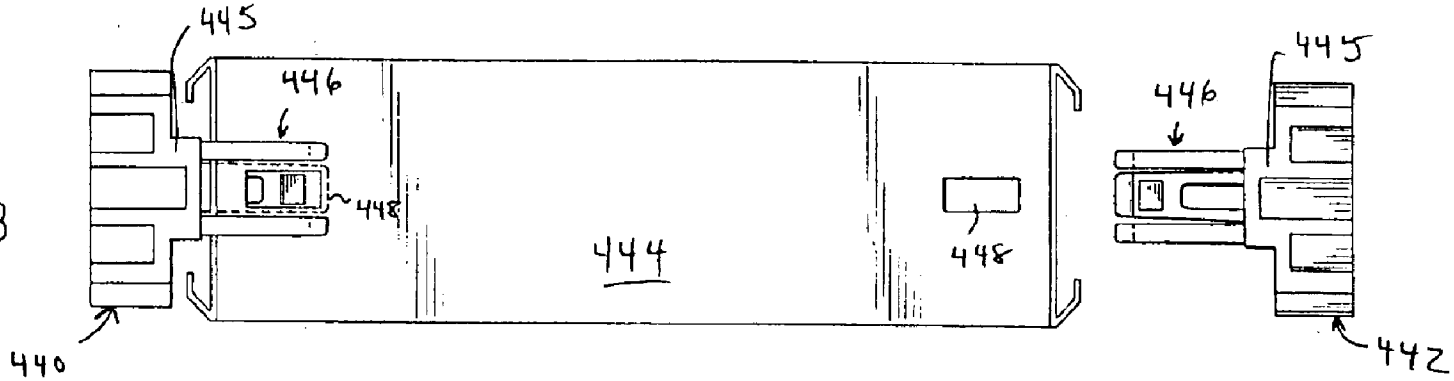
FIG. 38 is a plan view of a pair of reflector holders and reflector according to another aspect of the present invention, with the reflector being shown shortened for illustration purposes.

Referring now to FIGS. 38–42, a second embodiment a quick connect reflector holder according to the present invention will be described. The previously described embodiment is particularly well suited to the attachment of reflectors into an already assembled luminaire. That is, the luminaire is assembled with the reflector holders as part of the end portions of the luminaire. After the luminaire is fully assembled, the reflectors may be inserted and attached to the reflector holders. The second embodiment is designed to further ease assembly by allowing the reflectors to be interconnected with the reflector holders during the assembly of the shell of the luminaire, rather than subsequent thereto. Referring first to FIG. 38, a reflector holder 440 and a second reflector holder 442 are shown with a reflector 444 positioned therebetween. Each reflector holder 440 and 442 has a base 445 with a set of jaws 446 projecting therefrom. The jaws 446 form a quick connect connector for engaging the reflector. These jaws 446 engage holes 448 near the ends of the reflector 444. The holes are preferably rectangular, as shown. The second reflector holder 442 is shown prior to engagement, while the first reflector holder 440 is shown engaged. The reflector holders 440 and 442 are brought towards one another and the jaws 446 engage opposite ends of the reflector 444. According to this second embodiment, the reflector holders 440 and 442 may be assembled as part of the end portions of the luminaire. Then, when the end portions are assembled onto the back portion of the housing, the reflector holders 440 and 442 can also engage the reflectors at the same time.

Figure 39:
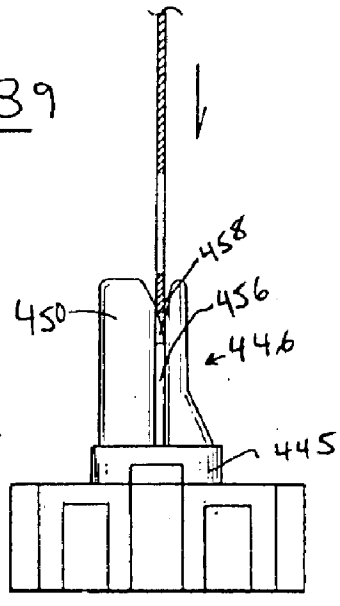
FIG. 39 is a side elevational view, partially in cross-section of a quick connect reflector holder with the reflector at the beginning of insertion.
Figure 42:
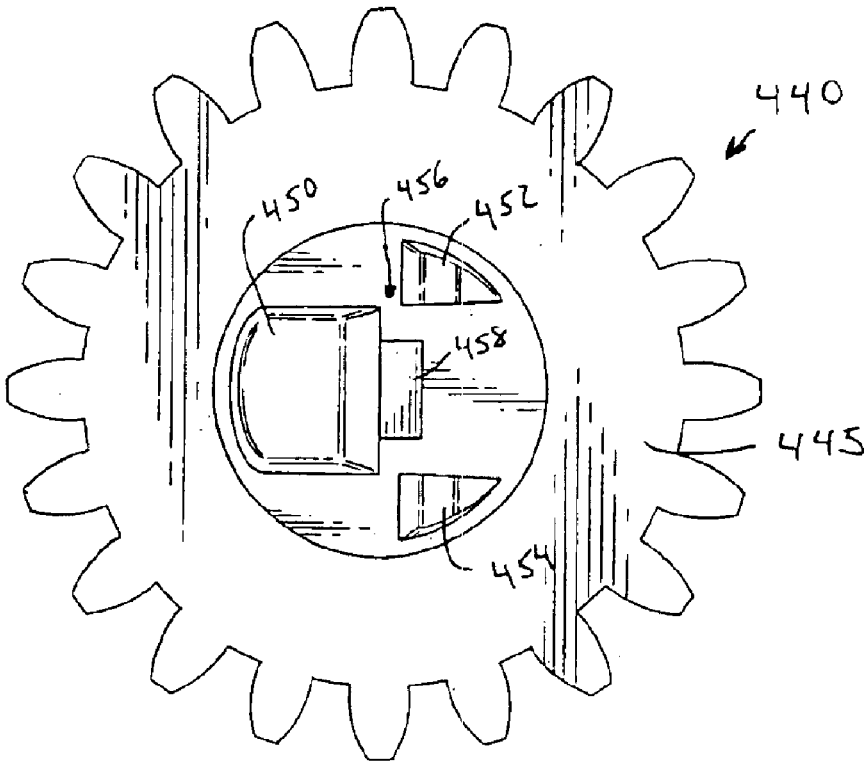
FIG. 42 is an end view of a quick connect reflector holder as used in FIGS. 38–41.

FIG. 39 shows reflector holder 440, with jaws 446, at the beginning of insertion of reflector 444. FIG. 42 shows an end view of the reflector holder 440 to show details of the jaws 446. As shown, the jaws 446 of the holder 440 comprise a single upper arm 450 and a pair of lower arms 452 and 454, with upper and lower being arbitrary positions. The upper arm 450 is spaced from the lower arms 452 and 454 so as to define a gap 456 therebetween. A tooth 458 extends from the upper arm 450 across the gap 456. The tooth 458 has a sloped outward facing surface and a blunt inwardly facing surface. This tooth 458 is designed to engage the rectangular engagement hole 448 in the reflector 444. As best shown in FIG. 42, the lower arms 452 and 454 are spaced apart and positioned to the sides of the upper arm. However, a single arm may be substituted.

Figure 41:
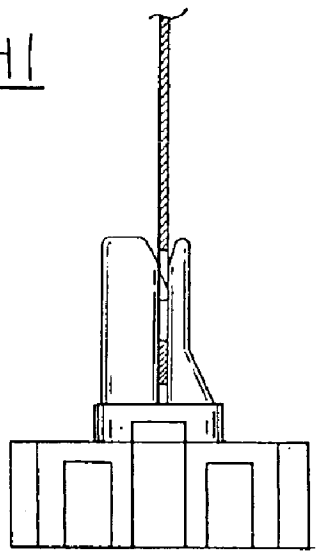
FIG. 41 is a view similar to FIGS. 39 and 40, with the reflector completely engaged.
Figure 40:
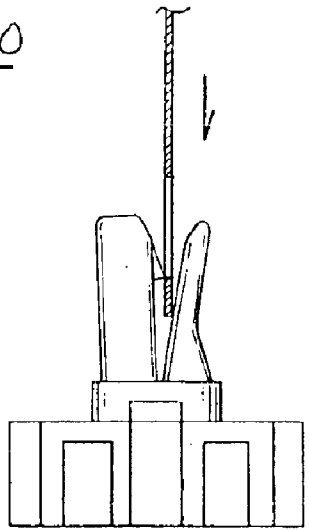
FIG. 40 is a view similar to FIG. 39 partially engaged.

Referring to FIGS. 39 to 41, it can be seen that the reflector 444 is pushed into the gap 456 between the upper 450 and lower 452 and 454 arms of the jaws 446 such that the end of the reflector 444 abuts the tooth 458. As shown in FIG. 39, the portions of the upper and lower arms 450–454 defining the gap 456 are generally parallel to one another prior to insertion of the reflector 444.

Referring now to FIG. 40, the reflector holder 440 and reflector 444 are shown with the reflector 444 partially inserted into the jaws 446 of the reflector holder 440. The lower arms 452 and 454 flex away from the upper arm 450, thereby widening the gap 456 between the arms. This allows the end of the reflector 444 to pass over the end of the tooth 458. Referring now to FIG. 41, the reflector 444 and holder 440 are shown after the reflector 444 has been fully inserted into the jaws 446 of the reflector holder. As shown, the end of the reflector 444 has now passed far enough that the tooth 458 extending from the upper arm 450 drops into the engagement hole 448 in the reflector, allowing the jaws 446 of the reflector holder 440 to return to their undeflected positions. Therefore, once again, the gap 456 between the upper and lower arms is shaped as it was prior to insertion of the reflector. As shown, the tooth 458 rests in the engagement hole 448 thereby retaining the reflector in the holder 440. Also, the tooth 458 prevents the reflector 444 from moving side to side in the reflector holder 440.

As will be clear to those of skill in the art, the two embodiments of quick connect reflector holders may be used in a single luminaire. For example, one of the second type of reflector holder may be used at one end why the first type is used at the other end. This allows reflectors to be changed after assembly. Also, while the second type of holder is designed to ease assembly, disassembly may also be allowed by flexing the reflector without taking the luminaire apart.

While there have been described what are preferred embodiments of the invention, it will be understood that various modifications may be made therein and the invention is intended to cover all such modifications as fall within the true spirit and scope of the invention.

I claim:

1. In combination:

a luminaire having a housing supporting a bulb and a plurality of adjustable reflectors disposed in the housing, at least one of the reflectors having a connection feature defined in an end thereof, the connection feature comprising a hole defined in the end of the reflector; and a reflector holder comprising:

a base; and a quick connect connector extending from the base, the connector configured for engaging the connection feature of the reflector such that the end of the reflector can be interconnected with the base by engaging the connector with the connection feature, the quick connect connector comprising a semi-arcuate flange member extending from the base, the flange member having a concave side with a connection post extending from the concave side to an outward end, the connector further comprising a lock ear extending from the outward end of the connection post toward the flange, the lock ear retaining the reflector against the flange.

2. The combination according to claim 1, wherein the connector further includes a second lock ear.

3. The combination according to claim 2, wherein the flange member has a pair of edges, the lock ears each having locking ends spaced from the edges of the flange member so as to define a gap between each locking end and one of the edges, the reflector being retained in the gap.

4. A reflector assembly for reflecting light from a bulb in a luminaire, the luminaire of the type having an elongated body with a top and a pair of side walls defining an opening for permitting a beam of light to be emitted, the luminaire further having a first end and a second end, the luminaire supporting the bulb, said reflector assembly comprising:

a reflector support unit having a first end and a second end, said reflector support unit configured for mounting within the body of the luminaire between the opening and the top such that said first end of said reflector support unit is adjacent the first end of the body and the second end of said reflector support unit is adjacent the second end of the body;

an elongated reflector having a first and a second end each including a hole defined therethrough;

a first and a second reflector holder, the first holder being supported by the first end of the support unit and the second holder being supported by the second end of the support unit, each holder comprising a base and a quick connect connector extending from the base, the connectors configured to engage the holes in the ends of the reflector, the quick connect connector for one of the holders comprising a semi-arcuate flange member extending from the base, the flange member having a concave side with a connection post extending from the concave side to an outward end, the connector further comprising a lock ear extending from the outward end of the connection post toward the flange, the lock ear retaining the reflector against the flange.

5. The reflector assembly according to claim 4, wherein the connector further includes a second lock ear.

6. The reflector assembly according to claim 5, wherein the flange member has a pair of edges, the lock ears each having locking ends spaced from the edges of the flange member so as to define a gap between each locking end and one of the edges, the reflector being retained in the gap.

7. A luminaire assembly having a luminaire frame, at least one module mounted in the frame, and a plurality of reflectors with a connection feature adjacent their ends, the connection features each comprising a hole defined in the end of the reflector, the luminaire frame having a pair of spaced apart ends and an opening for permitting a beam of light to be emitted from the frame, said module comprising:

a housing configured for mounting to one of the ends of the luminaire frame; and a plurality of adjustable reflector holders supported by the housing, at least one of the holders comprising a base with a quick connect connector extending from the base, the connector configured to engage the connection feature on one of the reflectors such that the holder supports the end of the reflector, the quick connect connector comprising a semi-arcuate flange member extending from the base, the flange member having a concave side with a connection post extending from the concave side to an outward end, the connector further comprising a lock ear extending from the outward end of the connection post toward the flange, the lock ear retaining the reflector against the flange.

8. The luminaire assembly according to claim 7, wherein the connector further includes a second lock ear.

9. The luminaire assembly according to claim 8, wherein the flange member has a pair of edges, the lock ears each having locking ends spaced from the edges of the flange member so as to define a gap between each locking end and one of the edges, the reflector being retained in the gap.

* * * * *